US010385593B2

(12) United States Patent
Machida et al.

(10) Patent No.: US 10,385,593 B2
(45) Date of Patent: Aug. 20, 2019

(54) REMOTE CONTROL FOR VEHICLES

(71) Applicant: AISIN SEIKI KABUSHIKI KAISHA, Kariya (JP)

(72) Inventors: Toshio Machida, Toyota (JP); Yasutaka Shinoda, Anjo (JP); Shinsuke Takayanagi, Okazaki (JP); Satoshi Takeno, Nishio (JP); Takeshi Nishikibe, Tokai (JP); Kohei Kobayashi, Ichinomiya (JP)

(73) Assignee: AISIN SEIKI KABUSHIKI KAISHA, Kariya-shi (JP)

( * ) Notice: Subject to any disclaimer, the term of this patent is extended or adjusted under 35 U.S.C. 154(b) by 895 days.

(21) Appl. No.: 14/423,294

(22) PCT Filed: Sep. 13, 2013

(86) PCT No.: PCT/JP2013/074906
§ 371 (c)(1),
(2) Date: Feb. 23, 2015

(87) PCT Pub. No.: WO2014/050617
PCT Pub. Date: Apr. 3, 2014

(65) Prior Publication Data

US 2015/0204113 A1 Jul. 23, 2015

(30) Foreign Application Priority Data

Sep. 26, 2012 (JP) ..... 2012-212687
Sep. 26, 2012 (JP) ..... 2012-212688

(51) Int. Cl.
*E05B 81/64* (2014.01)
*E05B 81/54* (2014.01)
(Continued)

(52) U.S. Cl.
CPC ..... *E05B 79/10* (2013.01); *E05B 77/265* (2013.01); *E05B 81/16* (2013.01); *E05B 81/54* (2013.01);
(Continued)

(58) Field of Classification Search
CPC ..... Y10S 292/46
(Continued)

(56) References Cited

U.S. PATENT DOCUMENTS 4,703,147 A * 10/1987 Happ ..... H05B 6/6417 200/50.02
4,968,074 A * 11/1990 Yamagishi ..... E05B 81/20 292/201
(Continued)

FOREIGN PATENT DOCUMENTS

CN 1573001 A 2/2005
EP 0 894 920 A1 2/1999
(Continued)

OTHER PUBLICATIONS

International Preliminary Report of Patentability and Written Opinion dated Mar. 31, 2015 in PCT/JP2013/074906 (English translation only).
(Continued)

*Primary Examiner* — Carlos Lugo
(74) *Attorney, Agent, or Firm* — Oblon, McClelland, Maier & Neustadt, L.L.P.

(57) ABSTRACT

A remote control device for a vehicle includes an interior handle coupling lever that rotates in accordance with manipulation of an interior manipulating handle, an exterior handle coupling lever that rotates in accordance with manipulation of an exterior manipulating handle, and a switch device. The switch device includes an interior manipulation detector for detecting rotation of the interior
(Continued)

manipulating handle, an exterior manipulation detector for detecting rotation of the exterior manipulating handle, and wiring members each having a detector connection terminal and an external connection terminal connected to the interior manipulation detector or the exterior manipulation detector. The remote control device further includes a body and a housing. The body accommodates the interior manipulation detector, the exterior manipulation detector, and the wiring members and has a connector portion enclosing all of the exterior connection terminals for the wiring members. The housing covers the body.

8 Claims, 11 Drawing Sheets

(51) Int. Cl.
*E05B 79/10* (2014.01)
*E05B 77/26* (2014.01)
*E05B 81/16* (2014.01)
*E05B 81/76* (2014.01)
*E05B 83/40* (2014.01)

(52) U.S. Cl.
CPC ..... *E05B 81/64* (2013.01); *E05B 81/76* (2013.01); *E05B 83/40* (2013.01); *Y10T 292/57* (2015.04)

(58) Field of Classification Search
USPC ..... 292/201, 216
See application file for complete search history.

(56) References Cited

U.S. PATENT DOCUMENTS 5,261,711 A * 11/1993 Mizuki ..... E05B 81/25 292/201
5,516,164 A * 5/1996 Kobayashi ..... E05B 81/20 292/201
5,564,308 A * 10/1996 Hoshikawa ..... E05B 81/25 292/201
5,582,448 A * 12/1996 Inoue ..... E05B 81/06 292/201
5,746,076 A 5/1998 Inoue
6,131,337 A * 10/2000 Machida ..... E05B 81/20 292/201
6,135,513 A * 10/2000 Hamada ..... E05B 77/26 292/201
6,412,222 B1 * 7/2002 Hashiba ..... B60J 5/06 296/155
6,416,088 B1 * 7/2002 Graute ..... E05B 81/14 292/201
6,955,389 B2 * 10/2005 Suzuki ..... E05B 65/0811 292/201
7,469,943 B2 * 12/2008 Hiramoto ..... E05B 81/06 292/201
7,488,014 B2 * 2/2009 Nozawa ..... E05B 81/06 292/201
8,333,414 B2 * 12/2012 Takayanagi ..... E05B 81/14 292/201
8,870,246 B2 * 10/2014 Itami ..... E05B 81/20 292/201
8,894,103 B2 * 11/2014 Shibayama ..... E05B 83/40 292/201
9,290,969 B2 * 3/2016 Yokota ..... E05B 81/20
2002/0056232 A1 * 5/2002 Choi ..... E05B 83/40 49/280
2003/0025337 A1 * 2/2003 Suzuki ..... E05B 81/20 292/195
2004/0262928 A1 12/2004 Fukunaga et al.
2005/0121920 A1 * 6/2005 Machida ..... E05B 81/20 292/201
2005/0236847 A1 * 10/2005 Taniyanna Masayuki ..... E05B 81/06 292/216
2006/0125244 A1 6/2006 Mochizuki et al.
2007/0284892 A1 12/2007 Nozawa
2009/0236863 A1 * 9/2009 Akizuki ..... E05B 81/14 292/201
2010/0117379 A1 * 5/2010 Mitchell ..... E05B 77/06 292/216
2011/0154740 A1 6/2011 Matsumoto et al.
2012/0056437 A1 3/2012 Takayanagi et al.

FOREIGN PATENT DOCUMENTS

JP 8 144602 6/1996
JP 2004 300826 10/2004
JP 2005 320690 11/2005
JP 2007-327238 A 12/2007
JP 2010 67362 3/2010
JP 2011 134633 7/2011
JP 2011 140811 7/2011
JP 2012 12810 1/2012
JP 2012 72645 4/2012

OTHER PUBLICATIONS

Japanese Office Action dated Apr. 26, 2016 in Patent Application No. 2012-212687 (without English Translation).
Combined Chinese Office Action and Search Report dated Mar. 2, 2016 in Patent Application No. 201380049137.X (with English language translation).
Japanese Office Action dated Oct. 6, 2015 in Patent Application No. 2012-212687 (without English Translation).
International Search Report dated Nov. 26, 2013 in PCT/JP2013/074906 Filed Sep. 13, 2013.

* cited by examiner

REMOTE CONTROL FOR VEHICLES

TECHNICAL FIELD

The art of the present disclosure relates to a remote control device for a vehicle that is capable of detecting manipulations of an interior manipulating handle and an exterior manipulating handle.

BACKGROUND ART

As a conventional example of such a remote control device for a vehicle, for example, that described in Patent Document 1 is known. As shown in FIG. 13, with this remote control device for a vehicle, a single protector 115 is fixed to one side surface of a baseplate 111, which rotationally supports an interior handle coupling lever linked to an interior manipulating handle and an exterior handle coupling lever linked to an exterior manipulating handle (both of which are not illustrated). Interior manipulating handle switches 112 and 113 configured to detect rotation of the interior handle coupling lever and an exterior manipulating handle switch 114 configured to detect rotation of the exterior handle coupling lever are mounted on the protector 115.

After mounting the interior manipulating handle switches 112 and 113 and the exterior manipulating handle switch 114 onto the protector 115 in advance, the protector 115 is fixed to the baseplate 111. The interior manipulating handle switches 112 and 113 and the exterior manipulating handle switch 114 can thereby be assembled together onto the one side surface of the baseplate 111.

Also, in the state of being fixed to the one side surface of the baseplate 111, the protector 115 covers the interior manipulating handle switches 112 and 113 and the exterior manipulating handle switch 114. Side surfaces of the interior manipulating handle switches 112 and 113 and the exterior manipulating handle switch 114 can thus be protected.

PRIOR ART DOCUMENTS

Patent Documents

Patent Document 1: Japanese Laid-Open Patent Publication No. 2012-12810

Patent Document 2: Japanese Laid-Open Patent Publication No. 2012-72645

SUMMARY OF THE INVENTION

Problems that the Invention is to Solve

The device of Patent Document 1 includes a collective electric wire 116 and a connector 117. The collective electric wire 116 is formed by collecting together a plurality of electric wires respectively connected to the interior manipulating handle switches 112 and 113 and the exterior manipulating handle switch 114 and is led outside the protector 115. The connector 117 is electrically connected to an external device and connected to a terminal of the collective electric wire 116. Therefore, terminals on one side of the respective electric wires in the collective electric wire 116 must be connected to the corresponding switches 112, 113, and 114 and terminals on the other side of the respective electric wires in the collective electric wire 116 must be connected to corresponding terminals among a plurality of external connection terminals provided inside the connector 117. For this purpose, the terminals of the respective electric wires in the collective electric wire 116 must be processed in various manners. For example, the respective electric wires must be stripped of coating and soldered. This inevitably increases of manufacturing steps.

An objective of the present disclosure is to provide a remote control device for a vehicle that limits increase of manufacturing steps, while adding a function of detecting manipulation of an interior manipulating handle and manipulation of an exterior manipulating handle.

To achieve the foregoing objective, a remote control device for a vehicle is provided. The remote control device includes a baseplate configured to be fixed on a vehicle door, an interior handle coupling lever, an exterior handle coupling lever, and a switch device. The interior handle coupling lever is supported on the baseplate and configured to rotate in accordance with manipulation of an interior manipulating handle to release a first door lock device, which holds the vehicle door in a fully closed state, or a second door lock device, which holds the vehicle door in a fully open state. The exterior handle coupling lever is supported on the baseplate and configured to rotate in accordance with manipulation of an exterior manipulating handle to release the first door lock device or the second door lock device. The switch device is supported on the baseplate and includes an interior manipulation detector that detects rotation of the interior handle coupling lever, an exterior manipulation detector that detects rotation of the exterior handle coupling lever, a plurality of wiring members, a body and a housing. Each wiring member has a detector connection terminal and an external connection terminal that are electrically connected to the interior manipulation detector or the exterior manipulation detector. The body houses the interior manipulation detector, the exterior manipulation detector, and the wiring members and has a connector portion that surrounds all the external connection terminals of the wiring members. The housing covers the body.

With this configuration, the interior manipulation detector, which detects rotation of the interior handle coupling lever, the exterior manipulation detector, which detects rotation of the exterior handle coupling lever, and the wiring members are housed inside the body and the external connection terminals of all of the wiring members are surrounded by the connector portion. The body is covered by the housing. In this case, the interior manipulation detector or the exterior manipulation detector is electrically connected to the detector connection terminal of the corresponding wiring member and thereby electrically connected to the corresponding external connection terminal surrounded by the connector portion. The interior manipulation detector and the exterior manipulation detector can thus be electrically connected to an external device at the respectively corresponding external connection terminals by an appropriate connector of the external device being attached to the connector portion. A step of connecting a terminal on one side of an electric wire to the interior manipulation detector or the exterior manipulation detector and connecting a terminal on the other side of the electric wire to a corresponding external connection terminal as in the conventional example is thus made unnecessary. This reduces manufacturing steps.

In contrast, as an example of a remote control device for a vehicle, for example, that described in Patent Document 2 is known. As shown in FIG. 14, this remote control device for a vehicle includes an interior handle coupling lever 101 linked to an interior manipulating handle, a full-open lock release lever 102 linked to the interior manipulating handle, an exterior handle coupling lever 103 linked to an exterior manipulating handle, a power coupling lever 104 linked to a release actuator, and a full-closure lock release lever 105. The interior handle coupling lever 101, the full-open lock release lever 102, the exterior handle coupling lever 103, the power coupling lever 104, and the full-closure lock release lever 105 are rotationally supported on a support shaft 106.

The interior handle coupling lever 101 is linkable to the full-closure lock release lever 105. The full-closure lock release lever 105 is linked to a front door lock device and a rear door lock device. When, for example, the interior manipulating handle is manipulated in a first direction (opening direction) and the interior handle coupling lever 101 rotates accordingly, the full-closure lock release lever 105 rotates to release the front door lock device and the rear lock device, which hold a sliding door in a fully closed state.

The full-open lock release lever 102 is linked to a full-open door lock device, which holds the sliding door in a fully open state. The full-open door lock device is configured to be released when, for example, the interior manipulating handle is manipulated in a second direction (closing direction) and the full-open lock release lever 102 rotates accordingly.

The exterior handle coupling lever 103 is linkable to the full-closure lock release lever 105. The exterior handle coupling lever 103 is also linked via the power coupling lever 104 to the full-open lock release lever 102. When, for example, the exterior manipulating handle is manipulated and the exterior handle coupling lever 103 rotates accordingly, the full-closure lock release lever 105 rotates to release the front door lock device and the rear lock device that hold the sliding door in the closed state. Further, when the exterior manipulating handle is manipulated and the exterior handle coupling lever 103 rotates accordingly, the full-open lock release lever 102 is made to rotate via the power coupling lever 104 to release the full-open door lock device, which holds the sliding door in the fully open state.

The power coupling lever 104 is linked to each of the full-closure lock release lever 105 and the full-open lock release lever 102. When the power coupling lever 104, which is actuated by the release actuator, rotates, the full-closure lock release lever 105 and the full-open lock release lever 102 rotate integrally therewith. Accordingly, the front door lock device and the rear lock device, which hold the sliding door in the fully closed state, are thereby released or the full-open door lock device, which holds the sliding door in the fully open state, is thereby released.

Also, the remote control device for a vehicle includes a switch 107 that turns on/off in accordance with rotation of the interior handle coupling lever 101 and a switch 108 that turns on/off in accordance with rotation of the full-open lock release lever 102. The vehicle is provided with an electrically-powered door opening/closing device (so-called power sliding door device) capable of electrically opening and closing the sliding door and detection signals of the switches 107 and 108 are supplied to a drive control of the electrically-powered door opening/closing device.

With this configuration, suppose, for example, that the interior manipulating handle is manipulated in the first direction (opening direction) when the sliding door is held in the fully closed state by the front door lock device and the rear door lock device. In this case, the interior handle coupling lever 101 rotates to rotate the full-closure lock release lever 105 and the front door lock device and the rear door lock device are released. This enables manual opening manipulation of the sliding door or electrically-powered sliding door opening actuation by the electrically-powered door opening/closing device.

In contrast, the switch 107 is turned on/off by rotation of the interior handle coupling lever 101 in accordance with the manipulation of the interior manipulating handle. Based on the detection signal of the switch 107, the release actuator is activated to maintain the released state of the front door lock device and the rear door lock device. The state in which the front door lock device and the rear door lock device are released is one of the actuation conditions of the electrically-powered door opening/closing device, and the release actuator is activated to more reliably maintain the released state of the front door lock device and the rear lock device even when the manipulation force on the interior manipulating handle is released before the electrically-powered door opening/closing device starts actuating to perform the sliding door opening actuation from the fully closed state.

Also, suppose that the interior manipulating handle is manipulated in the second direction (closing direction) when the sliding door is held in the fully open state by the full-open door lock device. In this case, the full-open lock release lever 102 rotates to release the full-open door lock device. This enables manual closing manipulation of the sliding door or electrically-powered sliding door closing actuation by the electrically-powered door opening/closing device. The switch 108 is turned on/off by rotation of the full-open lock release lever 102 in accordance with the manipulation of the interior manipulating handle.

Further, suppose that the exterior manipulating handle is manipulated when the sliding door is held in the fully closed state by the front door lock device and the rear door lock device. In this case, the exterior handle coupling lever 103 rotates to rotate the full-closure lock release lever 105, which releases the front door lock device and the rear door lock device. This enables manual opening manipulation of the sliding door or electrically-powered sliding door opening actuation by the electrically-powered door opening/closing device.

In contrast, by rotation of the exterior handle coupling lever 103 in accordance with the manipulation of the exterior manipulating handle, the full-open lock release lever 102 is rotated via the power coupling lever 104 and the switch 108 is turned on/off. Based on the detection signal of the switch 108, the release actuator is activated to maintain the released states of the front door lock device and the rear door lock device. The state in which the front door lock device and the rear door lock device are released is one of the actuation conditions of the electrically-powered door opening/closing device, and the release actuator is activated to more reliably maintain the released states of the front door lock device and the rear lock device even when the manipulation force on the exterior manipulating handle is released before the electrically-powered door opening/closing device starts actuating to perform the sliding door opening actuation from the fully closed state.

Also, suppose that the exterior manipulating handle is manipulated when the sliding door is held in the fully open state by the full-open door lock device. In this case, by rotation of the exterior handle coupling lever 103, the full-open lock release lever 102 is rotated via the power coupling lever 104 to release the full-open door lock device. This enables manual closing manipulation of the sliding door or electrically-powered sliding door closing actuation by the electrically-powered door opening/closing device. The switch 108 is turned on/off by rotation of the full-open lock release lever 102 in accordance with the manipulation of the exterior manipulating handle.

Further, suppose that the release actuator is activated without manipulation of the interior manipulating handle or the exterior manipulating handle when the sliding door is held in the fully closed state by the front door lock device and the rear door lock device. In this case, the power coupling lever 104 rotates to rotate the full-closure lock release lever 105 and the front door lock device and the rear door lock device are released. The switch 108 is turned on/off in accordance with rotation of the full-open lock release lever 102 by rotation of the power coupling lever 104.

Similarly, suppose that the release actuator is activated without manipulation of the interior manipulating handle or the exterior manipulating handle when the sliding door is held in the fully open state by the full-open door lock device. In this case, the power coupling lever 104 rotates to rotate the full-open lock release lever 102 and the full-open door lock device is released. The switch 108 is turned on/off in accordance with rotation of the full-open lock release lever 102 by rotation of the power coupling lever 104.

According to Patent Document 2, the full-open lock release lever 102 is rotated by the activation of the release actuator and the switch 108 is always turned on/off accordingly.

Manipulation of the interior manipulating handle or the exterior manipulating handle may be adopted as manipulation of interrupting the sliding door opening/closing actuation by the electrically-powered door opening/closing device during the actuation. For example, when, during the sliding door opening actuation by the electrically-powered door opening/closing device, the interior manipulating handle is manipulated in the second direction (closing direction), the sliding door opening actuation is interrupted. Various situates requiring interruption of the sliding door opening actuation are thereby addressed.

In this case, the switch 108, which is turned on/off in accordance with rotation of the full-open lock release lever 102, is used to detect the manipulation of the interior manipulating handle. However, the full-open lock release lever 102 also rotates when the power coupling lever 104 is rotated by the activation of the release actuator, and the switch 108 is turned on/off in this process as well.

Therefore, for example, the detection signal of the switch 108 must not accepted in a period during which the release actuator is being activated. In other words, even when the interior manipulating handle is manipulated to interrupt, the sliding door opening actuation, it is necessary to wait until the activation is ended if the release actuator is being activated.

It is therefore desirable to enable detection of manipulation of the interior manipulating handle or the exterior manipulating handle even during the activation of the release actuator.

Accordingly, the present disclosure discloses a remote control device for a vehicle that includes an interior handle coupling lever, an exterior handle coupling lever, a power coupling lever, an interior opening manipulation detector, an interior closing manipulation detector, and an exterior manipulation detector. The interior handle coupling lever is configured to be linked to an interior manipulating handle and configured to rotate in a first direction in accordance with an opening manipulation of the interior manipulating handle to release a first door lock device that holds the vehicle door in a fully closed state and to rotate in a second direction opposite to the first direction in accordance with a closing manipulation of the interior manipulating handle to release a second door lock device that holds the vehicle door in an open state. The exterior handle coupling lever is configured to be linked to an exterior manipulating handle and configured to rotate independently from the interior handle coupling lever and in accordance with manipulation of the exterior manipulating handle to release the first door lock device or the second door lock device. The power coupling lever is configured to be linked to a release actuator and configured to rotate independently from the interior handle coupling lever and the exterior handle coupling lever and by drive force of the release actuator to release the first door lock device or the second door lock device. The interior opening manipulation detector detects rotation of the interior handle coupling lever in the first direction. The interior closing manipulation detector detects rotation of the interior handle coupling lever in the second direction. The exterior manipulation detector detects rotation of the exterior handle coupling lever.

With this configuration, when the interior manipulating handle is manipulated for opening, the interior handle coupling lever rotates in the first direction. This rotation in the first direction, that is, the opening manipulation of the interior manipulating handle is detected by the interior opening manipulation detector. In this process, the exterior handle coupling lever and the power coupling lever, which are independent from the interior handle coupling lever, do not rotate and the exterior manipulation detector does not perform the detection operation.

Also, when the interior manipulating handle is manipulated for closing, the interior handle coupling lever rotates in the second direction. This rotation in the second direction, that is, the closing manipulation of the interior manipulating handle is detected by the interior closing manipulation detector. In this process, the exterior handle coupling lever and the power coupling lever, which are independent from the interior handle coupling lever, do not rotate and the exterior manipulation detector does not perform the detection operation.

Further, when the exterior manipulating handle is manipulated, the exterior handle coupling lever rotates. This rotation, that is, the manipulation of the exterior manipulating handle is detected by the exterior manipulation detector. In this process, the interior handle coupling lever and the power coupling lever, which are independent from the exterior handle coupling lever, do not rotate and the interior opening manipulation detector and the interior closing manipulation detector do not perform the detection operations.

In contrast, when the release actuator is activated, the power coupling lever rotates. In this process, the interior handle coupling lever and the exterior handle coupling lever, which are independent from the power coupling lever, do not rotate and none of the interior opening manipulation detector, the interior closing manipulation detector, and the exterior manipulation detector performs the detection operation. That is, even when the release actuator is being activated, the respective manipulation detectors can detect the manipulations of the corresponding manipulating handles.

MODES FOR CARRYING OUT THE INVENTION

A remote control device for a vehicle according to one embodiment will now be described with reference to FIGS. 1 to 12. In the following description, the vehicle front/rear direction will be referred to simply as the "front/rear direction" and the vehicle up/down direction will be referred to simply as the "up/down direction."

Figure 1:
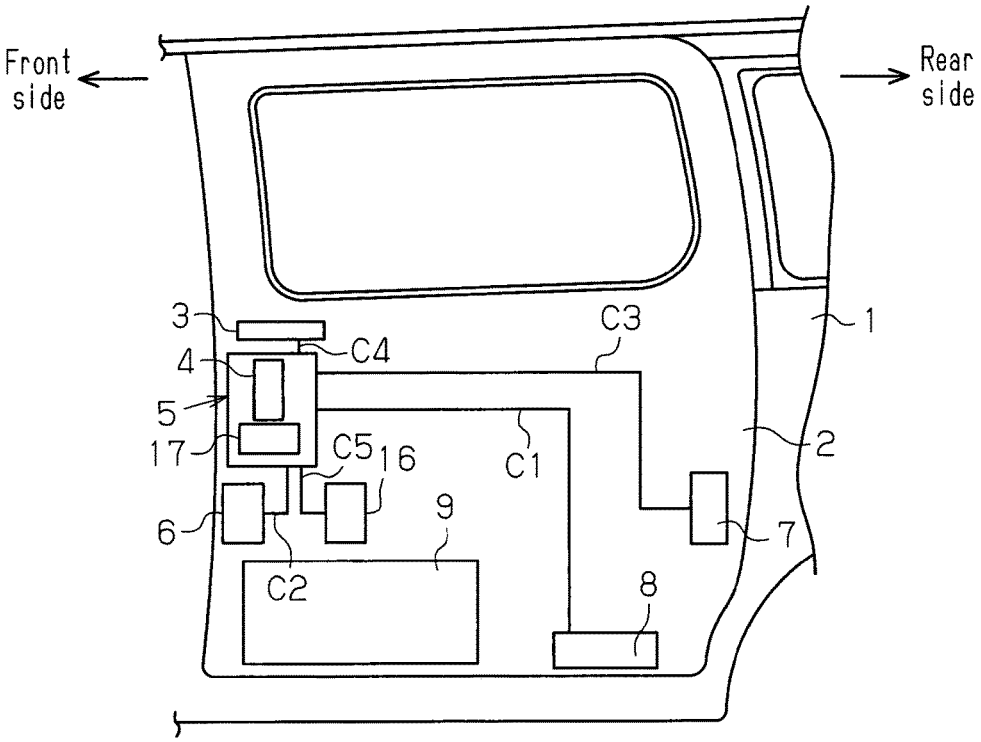
FIG. 1 is a front view of a vehicle door provided with a remote control device according to one embodiment.

As shown in FIG. 1, on a side portion of a vehicle body 1, a sliding door 2 is supported as a vehicle door via a suitable supporting member (unillustrated) to be movable in the front/rear direction. In accordance with the movement in the front/rear direction, the sliding door 2 opens and closes an entry/exit opening portion formed in the vehicle body 1.

A substantially arc-shaped exterior manipulating handle 3, which extends in the front/rear direction, is coupled to an outer surface front portion of the sliding door 2 and is pivotal about a rear end portion as a pivot. That is, the exterior manipulating handle 3 is supported on the sliding door 2 in a manner of being exposed to the vehicle exterior. The exterior manipulating handle 3 may be coupled to the sliding door 2 to be pivotal about a front end portion as a pivot, and the shape of the exterior manipulating handle 3 is not restricted to being substantially arc-shaped and may, for example, be a shape that extends in the up/down direction. In contrast, an interior manipulating handle 4, which extends in the up/down direction, is coupled to an inner surface front portion of the sliding door 2, to be pivotal about a central portion as a pivot.

Also, a remote control device 5, that is, a remote controller 5, which his linked to each of the exterior manipulating handle 3 and the interior manipulating handle 4, is installed in an internal space of the sliding door 2. The interior manipulating handle 4 is supported by the sliding door 2 via the remote controller 5 in a manner of being exposed to the vehicle interior.

Further in the internal space of the sliding door 2, a front door lock device 6 and a rear door lock device 7 are installed as a plurality of first door lock devices that are arranged on a front side and a rear side, respectively, and a full-open door lock device 8 is installed as a second door lock device that is arranged on the lower side. The front door lock device 6 and the rear door lock device 7 engage with the vehicle body 1 to hold the sliding door 2 in a closed state (fully closed state or ajar state) and the full-open door lock device 8 engages with the vehicle body 1 to hold the sliding door 2 in a fully open state.

Figure 2:
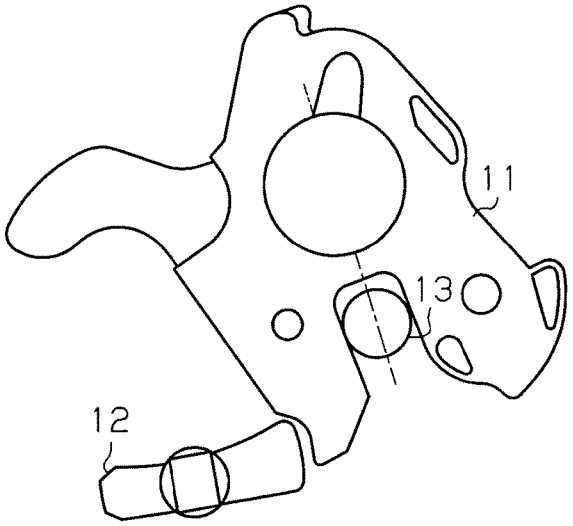
FIG. 2 is a schematic diagram of a front door lock device and a rear door lock device.

Specifically, as shown in FIG. 2, each of the front door lock device 6 and the rear door lock device 7 is configured to include a latch 11 and a pawl 12 and engages with a striker 13 fixed to the vehicle body 1 to hold the sliding door 2 in the closed state with respect to the vehicle body 1. That is, when the sliding door 2 is closed, the latch 11 engages with the striker 13 upon rotating. At the same time, the pawl 12 stops rotation of the latch 11 to hold the sliding door 2 in the closed state. Also, each of the front door lock device 6 and the rear door lock device 7 is linked to the remote controller 5 at the pawl 12. When power from the remote controller 5 moves the pawl 12 to cancel rotation stop of the latch 11, the latch 11 is urged by a return spring (not shown) and undergoes return rotation to cancel the state of engagement with the striker 13 and put the sliding door 2 in an openable state with respect to the vehicle body 1.

The full-open door lock device 8 has a structure similar to that described above and puts the sliding door 2 in a closable state with respect to the vehicle body 1 by being operated by power from the remote controller 5.

Each of the exterior manipulating handle 3 and the interior manipulating handle 4 can cooperate via the remote controller 5 with the front door lock device 6, the rear door lock device 7, and the full-open door lock device 8. Each of the exterior manipulating handle 3 and the interior manipulating handle 4 transmits power (manipulating force) resulting from manipulation by a user to each of the front door lock device 6, the rear door lock device 7, and the full-open door lock device 8 via the remote controller 5 to put the sliding door 2 in the openable state or closable state in the manners described above.

A release actuator 16 is also installed in the internal space of the sliding door 2. The release actuator 16 is linked to the remote controller 5 and can cooperate via the remote controller 5 with the front door lock device 6, the rear door lock device 7, and the full-open door lock device 8. The release actuator 16 transmits its own power (drive force) to each of the front door lock device 6, the rear door lock device 7, and the full-open door lock device 8 via the remote controller 5 to put the sliding door 2 in the openable state or closable state in the manners described above.

Further, a locking actuator 17 is supported by the remote controller 5. The locking actuator 17 is configured to perform switching between a locked state and an unlocked state of the sliding door 2. In the locked state of the sliding door 2, even when, for example, the exterior manipulating handle 3 is manipulated, the manipulating force is not transmitted by the remote controller 5 to the front door lock device 6 and the rear door lock device 7 and the sliding door 2 is not put in the openable state. In contrast, in the unlocked state of the sliding door 2, when, for example, the exterior manipulating handle 3 is manipulated, the remote controller 5 transmits the manipulating force to the front door lock device 6 and the rear door lock device 7 to put the sliding door 2 in the openable state.

An electrically-powered door opening/closing device (so-called power sliding door device) 9 capable of electrically opening and closing the sliding door 2 is installed in the vehicle.

The remote controller 5 will now be described further.

Figure 3:
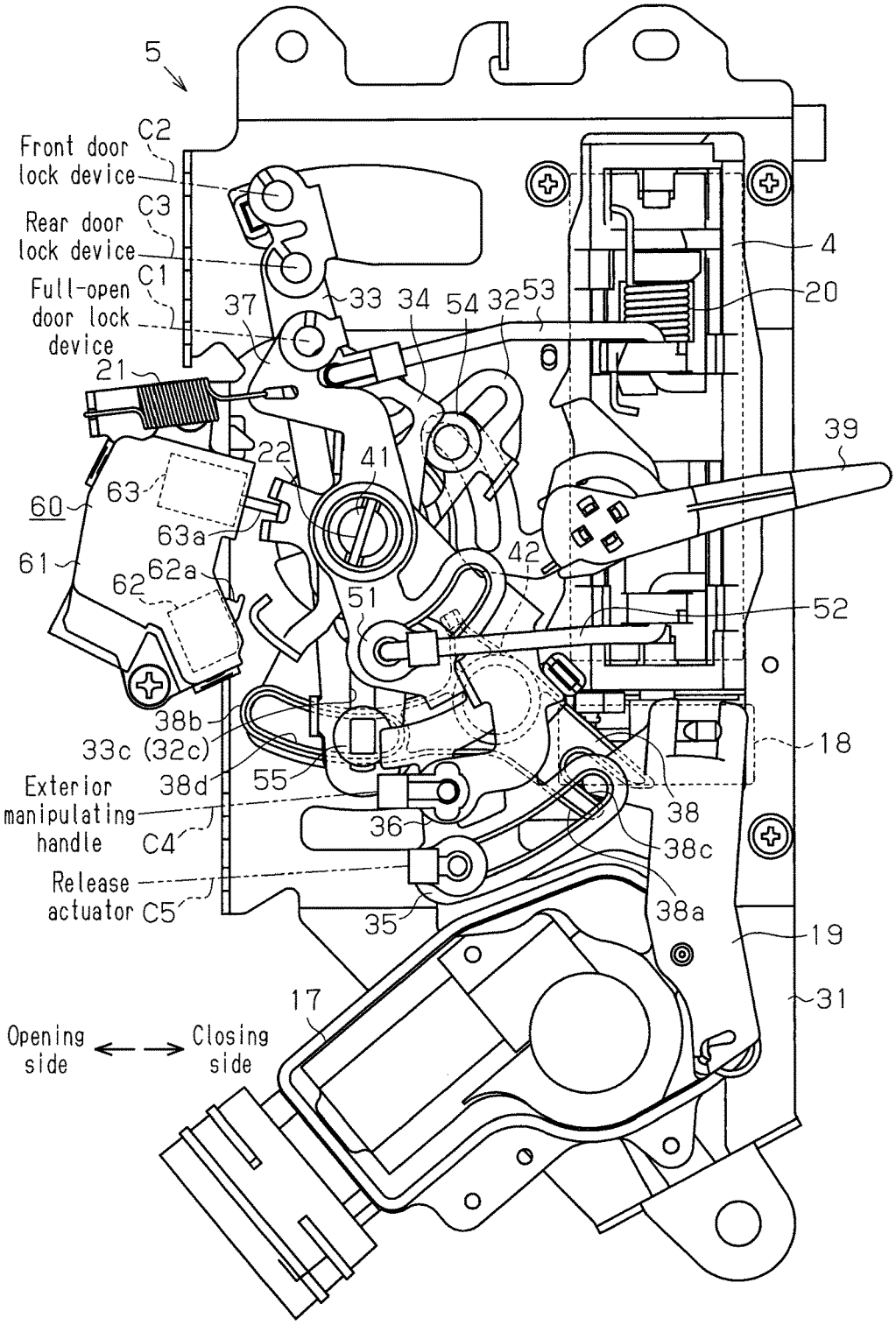
FIG. 3 is a front view of the remote control device of FIG. 1.

As shown in FIG. 3, the remote controller 5 includes a baseplate 31, which is configured, for example, from a metal plate, an opening lever 32, a full-closure lock release lever 33, an interior handle coupling lever 34, a power coupling lever 35, an exterior handle coupling lever 36, a full-open lock release lever 37, a locking lever 38, a child lock manipulating portion 39, and the locking actuator 17. The opening lever 32, the full-closure lock release lever 33, the interior handle coupling lever 34, the power coupling lever 35, the exterior handle coupling lever 36, and the full-open lock release lever 37 are overlapped in that order from the side closer to the baseplate 31 and are rotationally supported by a common main support shaft 41, which extends from the baseplate 31. The locking lever 38 is rotationally supported by an auxiliary support shaft 42 extending from the baseplate 31 in parallel to the main support shaft 41 on the lower right side of the main support shaft 41 in FIG. 3.

At the baseplate 31, the interior manipulating handle 4 is provided on a surface on the side (on the farther side of the sheet of FIG. 3 from the viewer) opposite to the side on which the opening lever 32 is located. A torsion coil spring 20 urges the interior manipulating handle 4 toward an origin position shown in FIG. 3 and holds it at the origin position. With the interior manipulating handle 4, an opening manipulation of tilting it from the origin position toward a sliding door 2 opening direction side (left side in FIG. 3) and a closing manipulation of tilting it from the origin position toward a sliding door 2 closing direction side (right side in FIG. 3) can be performed.

Also at the baseplate 31, an interior lock manipulating portion 18 is provided below the interior manipulating handle 4. The interior lock manipulating portion 18 is exposed to the vehicle interior of the sliding door 2. The interior lock manipulating portion 18 can be manipulated to move in opening and closing directions of the sliding door 2, that is, in the front/rear directions (the left and right directions in FIG. 3), and performs switching between the locked state and the unlocked state of the sliding door 2.

Figure 4:
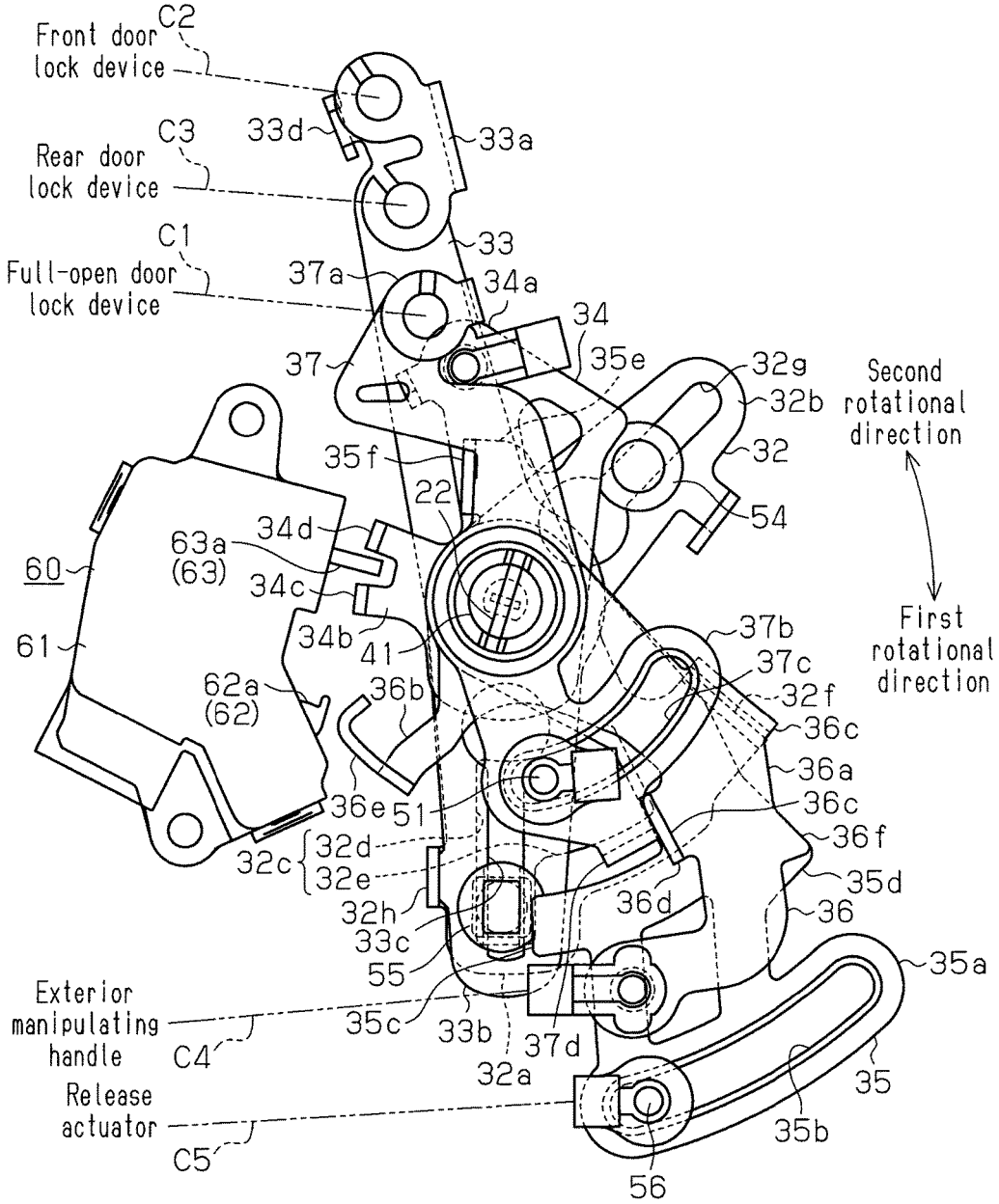
FIG. 4 is a front view of an initial state of the remote control device of FIG. 3.

As shown in FIG. 4, the full-open lock release lever 37 has a pair of lever projections 37*a* and 37*b* protruding in substantially opposite radial directions centered at the main support shaft 41. The first lever projection 37*a* has substantially an S shape and is coupled at its tip portion to the full-open door lock device 8 (pawl 12) via a cable C1.

The second lever projection 37*b* has substantially an L shape and has a portion extending in a radial direction from the main support shaft 41 and an arcuate portion extending, from the radially extending portion, in a second rotational direction (counterclockwise direction in FIG. 4) opposite to a first rotational direction (clockwise direction in FIG. 4) centered at the main support shaft 41. An interlocking contact piece 37*d* is formed at the tip of the second lever projection 37*b* separated from the main support shaft 41 The interlocking contact piece 37*d* is bent and raised at a right angle toward the exterior handle coupling lever 36 (in the direction orthogonal to the sheet of FIG. 4 and away from viewer).

Also, a slot 37*c* of substantially arcuate shape centered at the main support shaft 41 is formed through the arcuate portion of the second lever projection 37*b*. A slide bushing 51 is slidably supported inside the slot 37*c*. At the origin position of the full-open lock release lever 37, shown in FIGS. 3 and 4, the slide bushing 51 is arranged at an end of the slot 37*c* separated from the interior manipulating handle 4.

As shown in FIG. 3, the distal end of a rod-shaped link 52 extending from the interior manipulating handle 4 is fixed to the slide bushing 51. Therefore, when the interior manipulating handle 4 is manipulated for closing (tilted in the right direction in FIG. 3), the full-open lock release lever 37 is pushed by the link 52 to rotate in the first rotational direction (clockwise direction in FIGS. 3 and 4) around the main support shaft 41. The cable C1 coupled to the first lever projection 37*a* is then pulled toward the remote controller 5 so that the full-open door lock device 8 is released (the rotation restriction of the latch 11 by the pawl 12 is cancelled).

Also, although the link 52 is pulled toward the interior manipulating handle 4 when the interior manipulating handle 4 is manipulated for opening, the slide bushing 51 moves inside the slot 37*c* and therefore the full-open lock release lever 37 remains at the origin position shown in FIGS. 3 and 4. The full-open lock release lever 37 is urged in the second rotational direction by a torsion coil spring 21, which couples the baseplate 31 and the first lever projection 37*a* to each other.

As shown in FIG. 4, the interior handle coupling lever 34 has a first lever projection 34*a* protruding in a radial direction centered at the main support shaft 41 and extending substantially along the first lever projection 37*a*, and has a second lever projection 34*b* protruding in a radial direction (upper left direction in FIG. 4) differing from the first lever projection 34*a*. As shown in FIG. 3, a rod-shaped link 53, located above the link 52 and extending from the interior manipulating handle 4, has its distal end fixed to the tip portion of the first lever projection 34*a* separated from the main support shaft 41.

Therefore, when the interior manipulating handle 4 is manipulated for opening (tilted in the left direction in FIG. 3), the interior handle coupling lever 34 is pulled by the link 53 to rotate around the main support shaft 41 in the first rotational direction (clockwise direction in FIGS. 3 and 4). In contrast, when the interior manipulating handle 4 is manipulated for closing (tilted in the left direction in FIG. 3), the interior handle coupling lever 34 is pushed by the link 53 to rotate about the main support shaft 41 in the second rotational direction (counterclockwise direction in FIGS. 3 and 4). Also, the interior handle coupling lever 34 is held at the origin position shown in FIGS. 3 and 4 by the interior manipulating handle 4 being held at the origin position or returns to the origin position by the interior manipulating handle 4 returning to the origin position.

As shown in FIG. 4, the second lever projection 34*b* forms an opening-side switch depressing projection 34*c* and a closing-side switch depressing projection 34*d* branching from each other at the tip portion separated from the main support shaft 41.

The opening lever 32 is coupled to the main support shaft 41 via a torsion coil spring 22 wound around the main support shaft 41 and is urged in the second rotational direction by the torsion coil spring 22. The opening lever 32 has a pair of lever projections 32*a* and 32*b* that protrude in different radial directions (lower direction and upper right direction in FIG. 4) centered at the main support shaft 41. The first lever projection 32*a* is arranged to overlap with the full-closure lock release lever 33 and substantially has an L shape overall such that it extends in the second rotational direction (counterclockwise direction in FIG. 4) at a middle portion in the radial direction centered at the main support shaft 41.

A substantially L-shaped slot 32*c* is formed through the first lever projection 32*a* in accordance with its outer shape.

That is, the slot 32*c* includes an engaging hole 32*d* extending in the radial direction centered at the main support shaft 41 and a non-engaging hole 32*e* extending in the second rotational direction (counterclockwise direction in FIG. 4) from the tip of the engaging hole 32*d* near the main support shaft 41.

From the side edge portion of the first lever projection 32*a* facing the second rotational direction, an interlocking contact piece 32*f* is bent and raised at a right angle toward the exterior handle coupling lever 36 (in the direction orthogonal to the sheet of FIG. 4 and toward the viewer). Also, from the side edge portion of the first lever projection 32*a* facing the first rotational direction, an interlocking contact piece 32*h* is bent and raised at a right angle toward the full-closure lock release lever 33 (in the direction orthogonal to the sheet of FIG. 4 and toward the viewer).

The second lever projection 32*b* is located on the leading side in the first rotational direction relative to the interior handle coupling lever 34 (first lever projection 34*a*). A child lock slot 32*g*, extending in the radial direction centered at the main support shaft 41, is formed through the second lever projection 32*b*. A child lock pin 54 is inserted and supported in the child lock slot 32*g*. The child lock pin 54 is enabled to move reciprocally inside the child lock slot 32*g* while being guided by the pair of longitudinally-extending lateral sides of the child lock slot 32*g*.

As shown in FIG. 3, the child lock manipulating portion 39 performs manipulation of moving the child lock pin 54 from the exterior of the sliding door 2. That is, with the child lock manipulating portion 39, which is rotationally supported by the baseplate 31, a one end portion separated from rotation center is exposed from an end surface of the sliding door 2 and the other end portion separated from rotation center is coupled to the child lock pin 54. By a rotational manipulation of the child lock manipulating portion 39, the child lock pin 54 is moved between an child-lock lock position (not shown) separated from the main support shaft 41 and a child-lock unlock position near the main support shaft 41 shown in FIG. 3.

When the child lock pin 54 is at the child-lock unlock position, the child lock pin 54 is located within a rotation range of the interior handle coupling lever 34 (first lever projection 34*a*). Therefore, when the interior handle coupling lever 34 rotates in the first rotational direction, the opening lever 32 rotates integrally with the interior handle coupling lever 34 and together with the child lock pin 54. Power due to the opening manipulation of the interior manipulating handle 4 can thus be transmitted from the interior handle coupling lever 34 to the opening lever 32.

In contrast, when the child lock pin 54 is at the child-lock lock position, the child lock pin 54 is located outside rotation range of the interior handle coupling lever (first lever projection 34*a*). The interior handle coupling lever 34 and the opening lever 32 are thus uncoupled to be non-interlockable. The power due to the opening manipulation of the interior manipulating handle 4 thus cannot be transmitted from the interior handle coupling lever 34 to the opening lever 32.

As shown in FIG. 4, the full-closure lock release lever 33 has a pair of lever projections 33*a* and 33*b* protruding in substantially opposite radial directions centered at the main support shaft 41. The front door lock device 6 and the rear door lock device 7 (pawl 12) are respectively coupled via cables C2 and C3 to tip portions of the first lever projection 33*a* that projects to the same side as the interior handle coupling lever 34 (first lever projection 34*a*).

A substantially I-shaped slot 33*c*, extending in the radial direction centered at the main support shaft 41, is formed through the second lever projection 33*b*, which overlaps with the first lever projection 32*a* of the opening lever 32. The slot 33*c* can overlap with the engaging hole 32*d* of the slot 32*c* when the full-closure lock release lever 33 and the opening lever 32 are both at the origin position shown in FIG. 4. A common coupling pin 55 is inserted in the slots 33*c* and 32*c*. The coupling pin 55 is enabled to move reciprocally inside the slot 33*c* while being guided by the pair of longitudinally-extending lateral sides of the slot 33*c*.

The full-closure lock release lever 33 is enabled to contact the interlocking contact piece 32*h* of the opening lever 32 on the side edge portion of the second lever projection 33*b* facing the first rotational direction. The full-closure lock release lever 33 thus receives the urging force of the torsion coil spring 22 via the opening lever 32 to be urged in the second rotational direction. Normally, the full-closure lock release lever 33 and the opening lever 32 are both positioned at the origin position shown in FIG. 4 by a stopper portion 33*d*, which is provided at the tip portion of the first lever projection 33*a* and contacts the baseplate 31.

As shown in FIG. 3, the locking lever 38 has a first lever projection 38*a* extending toward the interior lock manipulating portion 18 from the auxiliary support shaft 42 and a second lever projection 38*b* extending toward the coupling pin 55 from the auxiliary support shaft 42. A substantially U-shaped, outwardly-spreading engaging groove 38*c* is formed in the tip of the first lever projection 38*a* and a substantially arcuate slot 38*d* is formed through the second lever projection 38*b*. The slot 38*d* can be overlapped with the slots 32*c* and 33*c* and the coupling pin 55 is movably inserted therein.

When the locking lever 38 is at a rotational position (that may hereinafter be referred to as the "unlock position") at which the coupling pin 55 is located in the engaging hole 32*d* of the slot 32*c*, the full-closure lock release lever 33, which is pressed by the coupling pin 55, can rotate integrally when the opening lever 32 rotates in the first rotational direction. That is, transmission of power from the opening lever 32 to the full-closure lock release lever 33 is enabled. The slot 38*d* of the locking lever 38 extends in a circumferential direction centered at the main support shaft 41 and therefore rotation of the coupling pin 55 is not obstructed by the slot 38*d*.

In contrast, when the locking lever 38 is at a rotational position (that may hereinafter be referred to as the "lock position") at which the coupling pin 55 is located in the non-engaging hole 32*e* of the slot 32*c*, even if the opening lever 32 rotates about the main support shaft 41 in the first rotational direction, the coupling pin 55 moves without being stopped in a relative manner in the non-engaging hole 32*e* so that the full-closure lock release lever 33 does not rotate. That is, the power of the opening lever 32 is not transmitted to the full-closure lock release lever 33 and the full-closure lock release lever 33 stays at the origin position shown in FIG. 4.

As shown in FIG. 3, the locking actuator 17 or the interior lock manipulating portion 18 performs the manipulation of rotating the locking lever 38 between the unlock position and the lock position.

The locking actuator 17 includes an electric motor activated by remote manipulation (manipulation of a remote control key or a centralized door lock button in the vehicle interior) as a main portion and has an output lever 19 coupled to the engaging groove 38*c* of the locking lever 38 (first lever projection 38*a*). When at the rotational position shown in FIG. 3, the output lever 19 positions the locking lever 38 at the unlock position. When at a predetermined rotational positon rotated in the second rotational direction from the rotational position shown in FIG. 3, the output lever 19 positions the locking lever 38 at the lock position.

In contrast, the interior lock manipulating portion 18 is coupled via the output lever 19 to the locking lever 38. When at the unlocking position shown in FIG. 3, the interior lock manipulating portion 18 positions the locking lever 38 at the unlock position via the output lever 19. When at a locking position, which is shifted to the left from the unlocking position as viewed in FIG. 3, the interior lock manipulating portion 18 positions the locking lever 38 at the lock position.

That is, by the locking actuator 17 being activated or by the interior lock manipulating portion 18 being manipulated to move (manipulated to lock or unlock), the locking lever 38 is rotated about the auxiliary support shaft 42 via the output lever 19 and the locking lever 38 moves to the unlock position or the lock position.

The exterior handle coupling lever 36 has a substantially arc-shaped first lever projection 36*a*, projecting in a radial direction centered at the main support shaft 41 and extending substantially along the opening lever 32 (first lever projection 32*a*) and the power coupling lever 35, and has a second lever projection 36*b* projecting in a radial direction (lower left direction in FIG. 4) different from the first lever projection 36*a*. The tip portion of the first lever projection 36*a* separated from the main support shaft 41 is coupled via a cable C4 to the exterior manipulating handle 3.

Also, from the side edge portion of the first lever projection 36*a* facing the second rotational direction, an interlocking contact piece 36*c* is bent and raised at a right angle toward the opening lever 32 (in the direction orthogonal to the sheet of FIG. 4 and toward the viewer). The interlocking contact piece 36*c* is arranged to oppose the interlocking contact piece 32*f* in the first rotational direction (clockwise direction in FIG. 4) of the exterior handle coupling lever 36.

Further, from the side edge portion of the first lever projection 36*a* facing the first rotational direction, an interlocking contact piece 36*d* is bent and raised at a right angle toward the full-open lock release lever 37 (in the direction orthogonal to the sheet of FIG. 4 and toward the viewer). The interlocking contact piece 36*d* is arranged to oppose the interlocking contact piece 37*d* in the first rotational direction (clockwise direction in FIG. 4) of the exterior handle coupling lever 36.

The exterior handle coupling lever 36 is enabled to contact the interlocking contact piece 37*d* of the full-open lock release lever 37 at the interlocking contact piece 36*d*. The exterior handle coupling lever 36 thus receives the urging force of the torsion coil spring 21 via the full-open lock release lever 37 to be urged in the second rotational direction. Normally, the exterior handle coupling lever 36 is positioned at the origin position shown in FIG. 4 by a stopper portion 36*f*, which is located at the tip portion of the first lever projection 36*a* contacts the baseplate 31. Also, the full-open lock release lever 37 is positioned at the origin position shown in FIG. 4 via the exterior handle coupling lever 36, which contacts the baseplate 31.

When the exterior manipulating handle 3 is manipulated, the exterior handle coupling lever 36 is pulled by the cable C4 to rotate about the main support shaft 41 in the first rotational direction (clockwise direction in FIG. 4) from the origin position. In this process, the opening lever 32, with which the interlocking contact piece 32*f* is pressed by the interlocking contact piece 36*c*, and the full-open lock release lever 37, with which the interlocking contact piece 37*d* is pressed by the interlocking contact piece 36*d*, rotate integrally about the main support shaft 41 in the first rotational direction (clockwise direction in FIG. 4).

Therefore, if the exterior manipulating handle 3 is manipulated with the locking lever 38 at the unlock position, the full-closure lock release lever 33 is rotated integrally via the exterior handle coupling lever 36, the opening lever 32, and the coupling pin 55, in the first rotational direction about the main support shaft 41 from the origin position. The cables C2 and C3, coupled to the first lever projection 33*a* of the full-closure lock release lever 33 are then pulled toward the remote controller 5 so that the front door lock device 6 and the rear door lock device 7 (rotation restrictions of the latches 11 by the pawls 12) are released. That is, the front door lock device 6 and the rear door lock device 7 are released by the manipulating force of the exterior manipulating handle 3 being transmitted via the exterior handle coupling lever 36, the opening lever 32, and the coupling pin 55 to the full-closure lock release lever 33.

When the exterior manipulating handle 3 is manipulated, the full-open lock release lever 37 is rotated integrally via the exterior handle coupling lever 36 in the first rotational direction about the main support shaft 41 from the origin position, regardless of the position (unlock position or lock position) of the locking lever 38. The cable C1, which is coupled to the first lever projection 37*a* of the full-open lock release lever 37, is then pulled toward the remote controller 5 so that the full-open door lock device 8 (rotation restriction of the latch 11 by the pawl 12) is released. That is, the full-open door lock device 8 is released by the manipulating force of the exterior manipulating handle 3 being transmitted via the exterior handle coupling lever 36 to the full-open lock release lever 37.

As shown in FIG. 4, the second lever projection 36*b* forms a substantially L-shaped switch depressing projection 36*e* at the tip separated from the main support shaft 41.

The power coupling lever 35 has a substantially hammer-shaped lever projection 35*a*, projecting in a radial direction centered at the main support shaft 41 and extending substantially along the opening lever 32 (first lever projection 32*a*) and the exterior handle coupling lever 36 (first lever projection 36*a*). A substantially arcuate slot 35*b*, which extends in a circumferential direction centered at the main support shaft 41, is formed through the tip portion of the lever projection 35*a* separated from the main support shaft 41, and a slide bushing 56 is slidably supported in the slot 35*b*. The slide bushing 56 is coupled via a cable C5 to the release actuator 16. The release actuator 16 includes as a main portion an electric motor, which is activated by remote manipulation (manipulation of the remote control key or the centralized door lock button in the vehicle interior).

Also, an interlocking contact piece 35*c* is formed to project from the side edge portion of the lever projection 35*a* facing the first rotational direction. The interlocking contact piece 35*c* is disposed to oppose the coupling pin 55 in the first rotational direction (clockwise direction in FIG. 4) of the power coupling lever 35 when the locking lever 38 is at the unlock position.

Further, the power coupling lever 35 has a substantially tongue-shaped lever projection 35*e* protruding in a radial direction centered at the main support shaft 41 and extending substantially along the full-open lock release lever 37 (first lever projection 37*a*). From the side edge portion of the lever projection 35*e* facing the second rotational direction, an interlocking contact piece 35*f* is bent and raised at a right angle toward the full-open lock release lever 37 (in the direction orthogonal to the sheet of FIG. 4 and toward the viewer). The interlocking contact piece 35*f* is arranged to oppose the side edge portion of the full-open lock release lever 37 (first lever projection 37*a*) in the first rotational direction (clockwise direction in FIG. 4) of the power coupling lever 35.

The power coupling lever 35 is enabled to contact the side edge portion of the full-open lock release lever 37 at the interlocking contact piece 35*f*. The power coupling lever 35 thus receives the urging force of the torsion coil spring 21 via the full-open lock release lever 37 to be urged in the second rotational direction. Normally, the power coupling lever 35 is positioned at the origin position shown in FIG. 4 by a stopper portion 35*d*, provided at the tip portion of the lever projection 35*a*, contacting the baseplate 31. Also, the full-open lock release lever 37, which urges the power coupling lever 35 in the second rotational direction, is positioned at the origin position shown in FIG. 4 via the power coupling lever 35 that contacts the baseplate 31.

Therefore, when the release actuator 16 is activated and its drive force pulls the cable C5 toward the release actuator 16, the power coupling lever 35 rotates in the first rotational direction about the main support shaft 41 from the origin position in a state of being uncoupled from the interior handle coupling lever 34 and the exterior handle coupling lever 36. If, in this process, the locking lever 38 is at the unlock position, the interlocking contact piece 35*c* pushes the coupling pin 55 so that, via the coupling pin 55, the full-closure lock release lever 33 (and the opening lever 32) rotates integrally in the first rotational direction about the main support shaft from the origin position. The cables C2 and C3, which are coupled to the first lever projections 33*a* of the full-closure lock release lever 33, are then pulled toward the remote controller 5 so that the front door lock device 6 and the rear door lock device 7 (rotation restrictions of the latches 11 by the pawls 12) are released.

At the same time, the interlocking contact piece 35*f* of the power coupling lever 35 presses the full-open lock release lever 37 so that the full-open lock release lever 37 rotates integrally with the power coupling lever 35 in the first rotational direction about the main support shaft 41 from the origin position. The cable C1, which is coupled to the first lever projection 37*a* of the full-open lock release lever 37, is then pulled toward the remote controller 5 so that the full-open door lock device 8 (rotation restriction of the latch 11 by the pawl 12) is released.

Even when the release actuator 16 is activated, if the locking lever 38 is at the lock position, the interlocking contact piece 35*c* does not press the coupling pin 55 and therefore the full-closure lock release lever 33 (and the opening lever 32) remains at the origin position.

As shown in FIG. 4, the baseplate 31 has a switch device 60 installed in accordance with the positions of the opening-side switch depressing projection 34*c* and the closing-side switch depressing projection 34*d* of the interior handle coupling lever 34 at the origin position and the switch depressing projection 36*e* of the exterior handle coupling lever 36 at the origin position. The switch device 60 includes a case 61 made, for example, of plastic and constituting a housing of the switch device 60, and an exterior manipulating handle switch 62 and an interior manipulating handle switch 63, which are housed inside the case 61.

The interior manipulating handle switch 63, which functions as an interior manipulation detector, is, for example, a momentary double-throw switch, and a switch lever 63*a* at a neutral position is arranged at a central portion between the opening-side switch depressing projection 34*c* and the closing-side switch depressing projection 34*d* of the interior handle coupling lever 34 at the origin position. That is, the switch lever 63*a* is located within a rotation range of the opening-side switch depressing projection 34*c* when the interior handle coupling lever 34 rotates in the first rotational direction and is located within a rotation range of the closing-side switch depressing projection 34*d* when the interior handle coupling lever 34 rotates in the second rotational direction.

Figure 5:
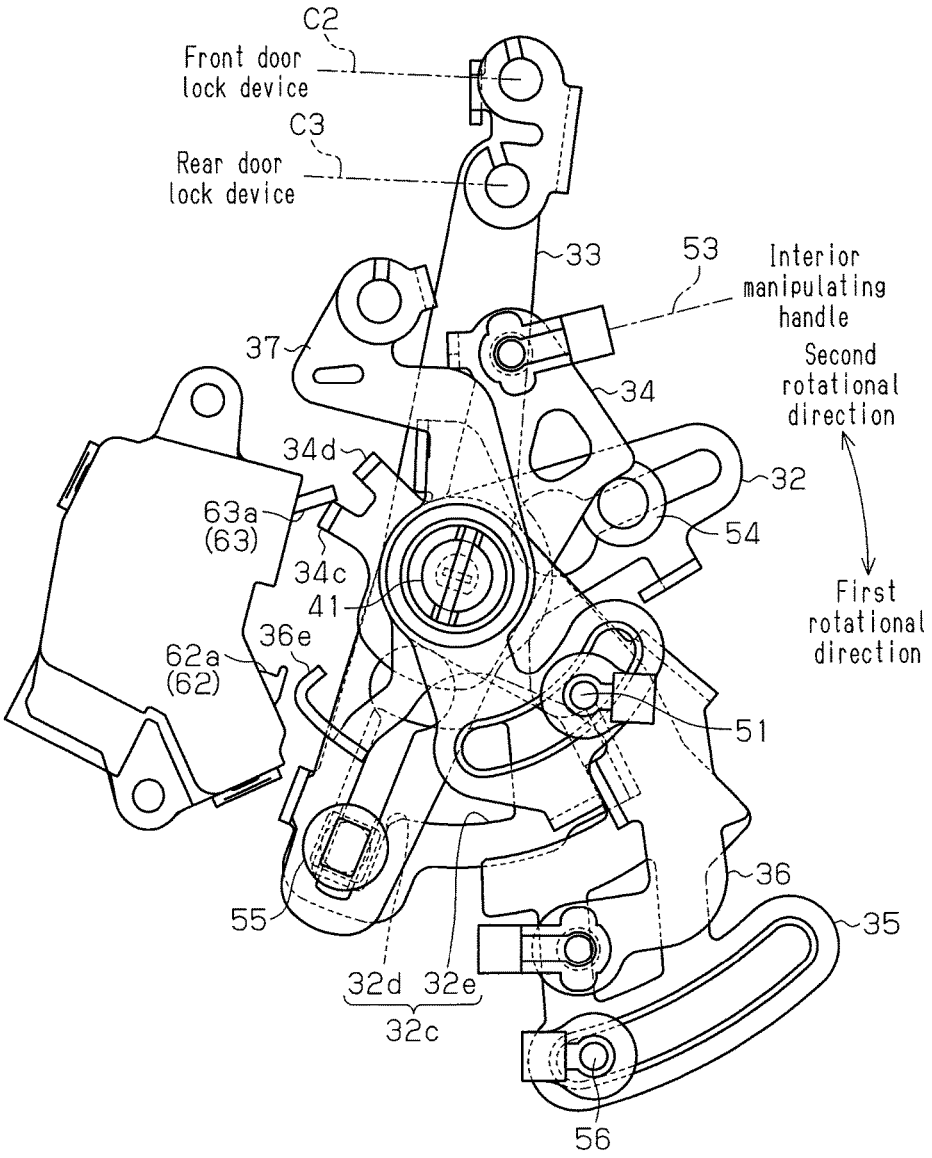
FIG. 5 is a front view of the remote control device of FIG. 3 in a state during an opening manipulation of an interior manipulating handle.

Therefore, as illustrated by the change from the state shown in FIG. 4 to the state shown in FIG. 5, when the interior handle coupling lever 34 rotates in the first rotational direction in accordance with the opening manipulation of the interior manipulating handle 4, the switch lever 63*a* is pressed to tilt in one direction from the neutral position by the opening-side switch depressing projection 34*c*. In this process, the interior manipulating handle switch 63 switches from the OFF state to a first ON state.

The interior manipulating handle switch 63 thus detects the opening manipulation of the interior manipulating handle 4 directly. More specifically, the interior manipulating handle switch 63 detects, during the sliding door 2 closing actuation by the electrically-powered door opening/closing device 9, an intention of a user to interrupt the actuation. That is, if, during the sliding door 2 closing actuation by the electrically-powered door opening/closing device 9, the opening manipulation of the interior manipulating handle 4 is detected by the interior manipulating handle switch 63, the sliding door 2 closing actuation by the electrically-powered door opening/closing device 9 is interrupted.

However, if the release of the front door lock device 6 and the rear door lock device 7 is completed manually in accordance with the opening manipulation of the interior manipulating handle 4 with the sliding door 2 being in the fully closed state, the sliding door 2 may be actuated to open by the electrically-powered door opening/closing device 9 or the sliding door 2 may be manipulated to open manually.

Figure 6:
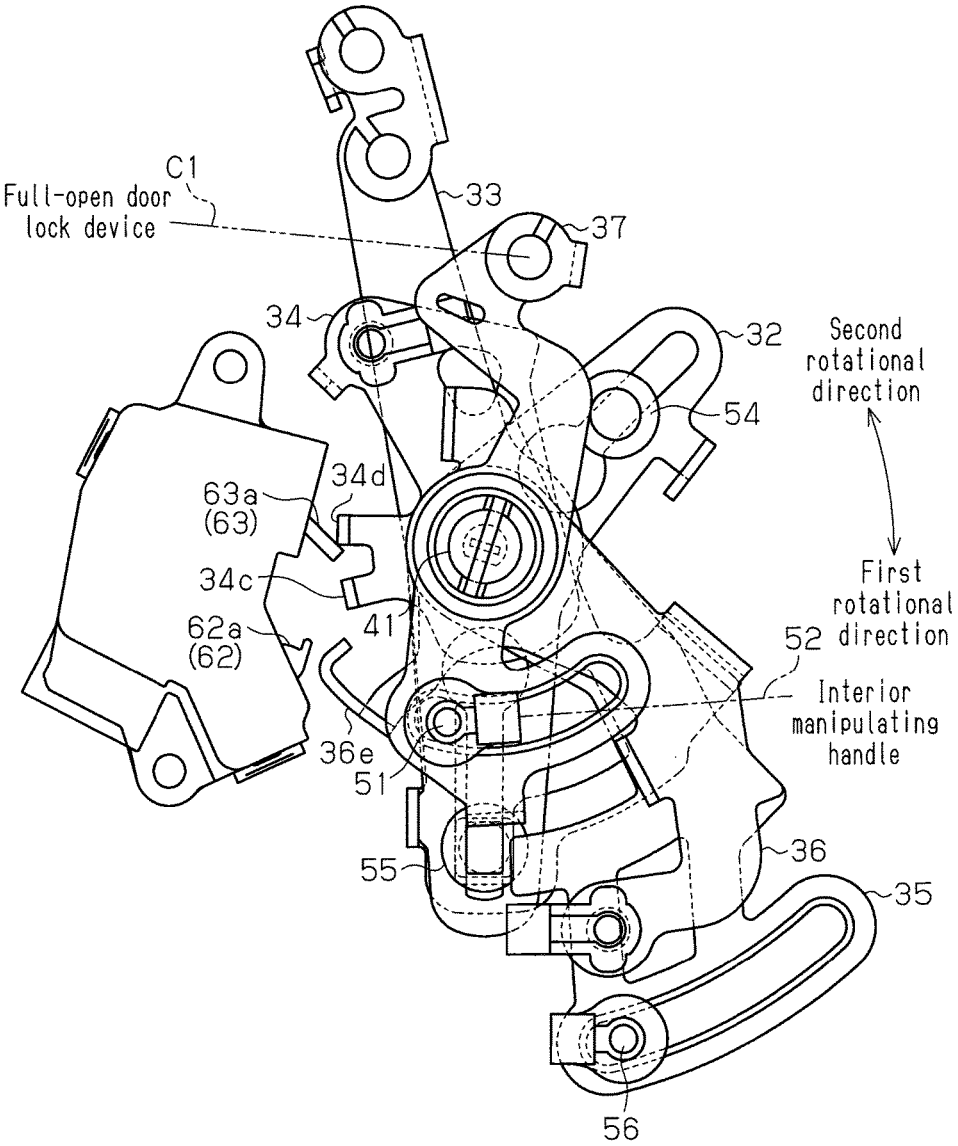
FIG. 6 is a front view of the remote control device of FIG. 3 in a state during a closing manipulation of the interior manipulating handle.

In contrast, as illustrated by the change from the state shown in FIG. 4 to the state shown in FIG. 6, when the interior handle coupling lever 34 rotates in the second rotational direction in accordance with the closing manipulation of the interior manipulating handle 4, the switch lever 63*a* is pressed to tilt in the opposite direction from the neutral position by the closing-side switch depressing projection 34*d*. In this process, the interior manipulating handle switch 63 switches from the OFF state to a second ON state.

The interior manipulating handle switch 63 thus detects the closing manipulation of the interior manipulating handle 4 directly. More specifically, the interior manipulating handle switch 63 detects, during the sliding door 2 opening actuation by the electrically-powered door opening/closing device 9, an intention of the user to interrupt the actuation. That is, if, during the sliding door 2 opening actuation by the electrically-powered door opening/closing device 9, the closing manipulation of the interior manipulating handle 4 is detected by the interior manipulating handle switch 63, the sliding door 2 opening actuation by the electrically-powered door opening/closing device 9 is interrupted.

However, if the release of the full-open door lock device 8 is completed manually in accordance with the closing manipulation of the interior manipulating handle 4 with the sliding door 2 being in the fully open state, the sliding door 2 may be actuated to close by the electrically-powered door opening/closing device 9 or the sliding door 2 may be manipulated to close manually.

As shown in FIG. 4, the exterior manipulating handle switch 62, which functions as an exterior manipulation detector, is, for example, a momentary single-throw switch, and a switch lever 62*a* at a neutral position is located within a rotation range of the switch depressing projection 36*e* when the exterior handle coupling lever 36 at the origin position rotates in the first rotational direction. Therefore, as illustrated by the change from the state shown in FIG. 4 to the state shown in FIG. 7, when the exterior handle coupling lever 36 rotates in the first rotational direction in accordance with the manipulation of the exterior manipulating handle 3, the switch lever 62*a* is pressed to tilt by the switch depressing projection 36*e*. In this process, the exterior manipulating handle switch 62 switches from the OFF state to the ON state.

The exterior manipulating handle switch 62 thus detects the manipulation of the exterior manipulating handle 3 directly. More specifically, the exterior manipulating handle switch 62 detects, during the sliding door 2 opening actuation or closing actuation by the electrically-powered door opening/closing device 9, an intention of a user to interrupt the actuation. That is, if, during the sliding door 2 opening actuation or closing actuation by the electrically-powered door opening/closing device 9, manipulation of the exterior manipulating handle 3 is detected by the exterior manipulating handle switch 62, the sliding door 2 opening or closing actuation by the electrically-powered door opening/closing device 9 is interrupted.

However, if the release of the front door lock device 6 and the rear door lock device 7 is completed manually in accordance with manipulation of the exterior manipulating handle 3 with the sliding door 2 being in the fully closed state, the sliding door 2 may be actuated to open by the electrically-powered door opening/closing device 9 or the sliding door 2 may be manipulated to open manually. Alternatively, if the release of the full-open door lock device 8 is completed manually in accordance with manipulation of the exterior manipulating handle 3 with the sliding door 2 being in the fully open state, the sliding door 2 may be actuated to close by the electrically-powered door opening/closing device 9 or the sliding door 2 may be manipulated to close manually.

Figure 8:
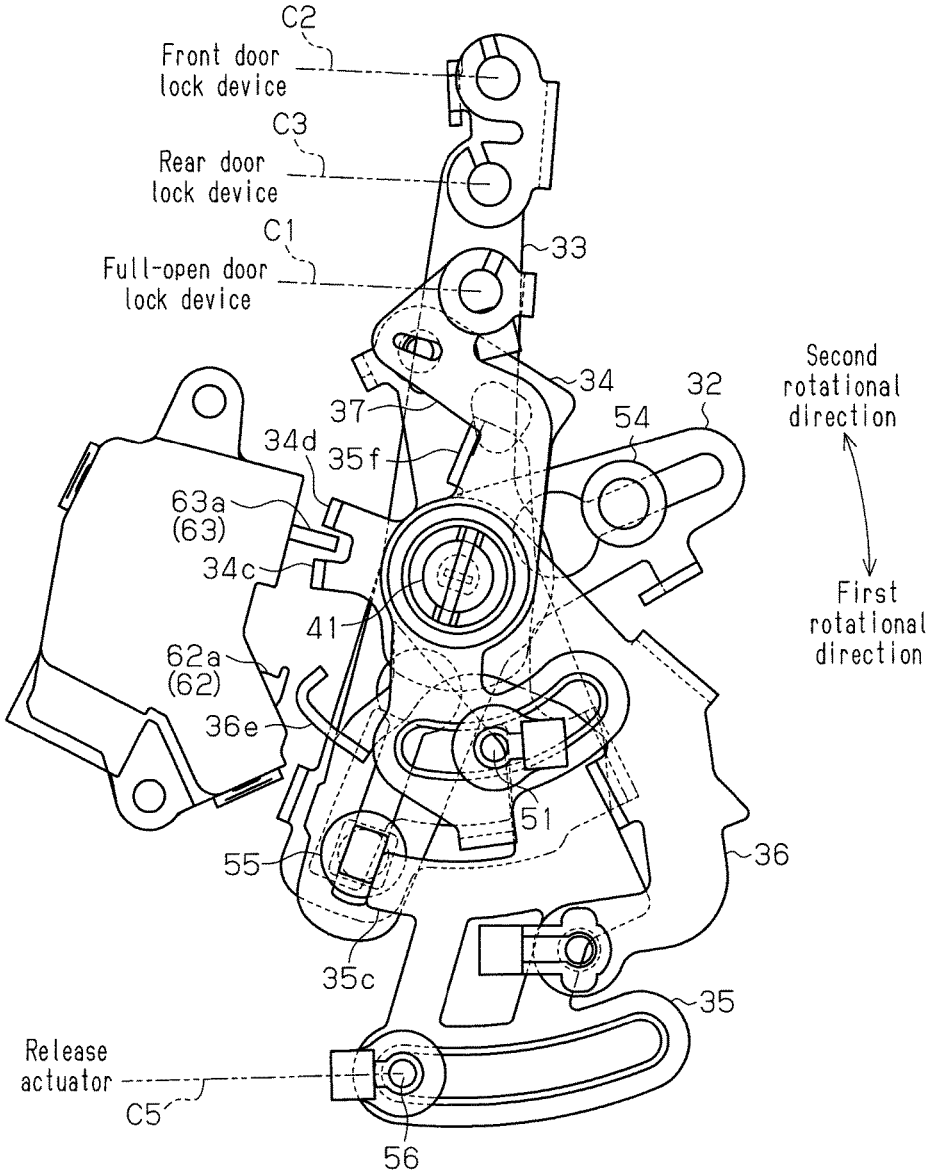
FIG. 8 is a front view of the remote control device of FIG. 3 in a state during activation of a release actuator.

When the release actuator 16 is activated to release the front door lock device 6 and the rear door lock device 7 or the full-open door lock device 8 as mentioned above, the power coupling lever 35 rotates in the first rotational direction about the main support shaft 41 from the origin position in a state of being uncoupled from the interior handle coupling lever 34 and the exterior handle coupling lever 36 as illustrated by the change from the state shown in FIG. 4 to the state shown in FIG. 8. The exterior manipulating handle switch 62 and the interior manipulating handle switch 63 are therefore not actuated by rotation of the power coupling lever 35 and the exterior manipulating handle switch 62 and the interior manipulating handle switch 63 remain in the OFF state.

That is, with the present embodiment, manipulation of the exterior manipulating handle 3 is detected by the exterior manipulating handle switch 62 being put in the ON state, opening manipulation of the interior manipulating handle 4 is detected by the interior manipulating handle switch 63 being put in the first ON state, and closing manipulation of the interior manipulating handle 4 is detected by the interior manipulating handle switch 63 being put in the second ON state. Also, even when the power coupling lever 35 is actuated to rotate in the first rotational direction by the release actuator 16, the exterior manipulating handle switch 62 and the interior manipulating handle switch 63 remain in the OFF state. Manipulation of the exterior manipulating handle 3 and opening and closing manipulations of the interior manipulating handle 4 can thus be detected by the exterior manipulating handle switch 62 and the interior manipulating handle switch 63 even during activation of the release actuator 16. This enables, for example, the sliding door 2 opening or closing actuation by the electrically-powered door opening/closing device 9 to be interrupted by manipulation of the exterior manipulating handle 3 or opening or closing manipulation of the interior manipulating handle 4 even during activation of the release actuator 16.

Operation of the present embodiment will now be described. In the following description, it will be deemed that the child lock pin 54 is at the child-lock unlock position and the locking lever 38 is at the unlock position. The position (unlock position or lock position) of the locking lever 38 is configured to be detected by a suitable position switch.

First, when the interior manipulating handle 4 is manipulated for opening the sliding door 2 in the fully closed state, the interior handle coupling lever 34, which is pulled by the link 53, rotates about the main support shaft 41 in the first rotational direction to press the child lock pin 54 so that the opening lever 32 rotates integrally with the interior handle coupling lever 34 in the first rotational direction as illustrated by the change from the state shown in FIG. 4 to the state shown in FIG. 5. The rotation of the opening lever 32 is transmitted via the coupling pin 55 to the full-closure lock release lever 33 so that, together with the opening lever 32, the full-closure lock release lever 33 rotates integrally in the first rotational direction. The cables C2 and C3 are thereby pulled toward the remote controller 5 and the front door lock device 6 and the rear door lock device 7 are released. The sliding door 2 is thus put in the openable state.

In contrast, when the interior manipulating handle 4 is manipulated for closing the sliding door 2 in the fully open state, the full-open lock release lever 37, which is pressed by the link 52, rotates in the first rotational direction as illustrated by the change from the state shown in FIG. 4 to the state shown in FIG. 6. The cable C1 is thereby pulled toward the remote controller 5 and the full-open door lock device 8 is released. The sliding door 2 is thus put in the closable state.

Figure 7:
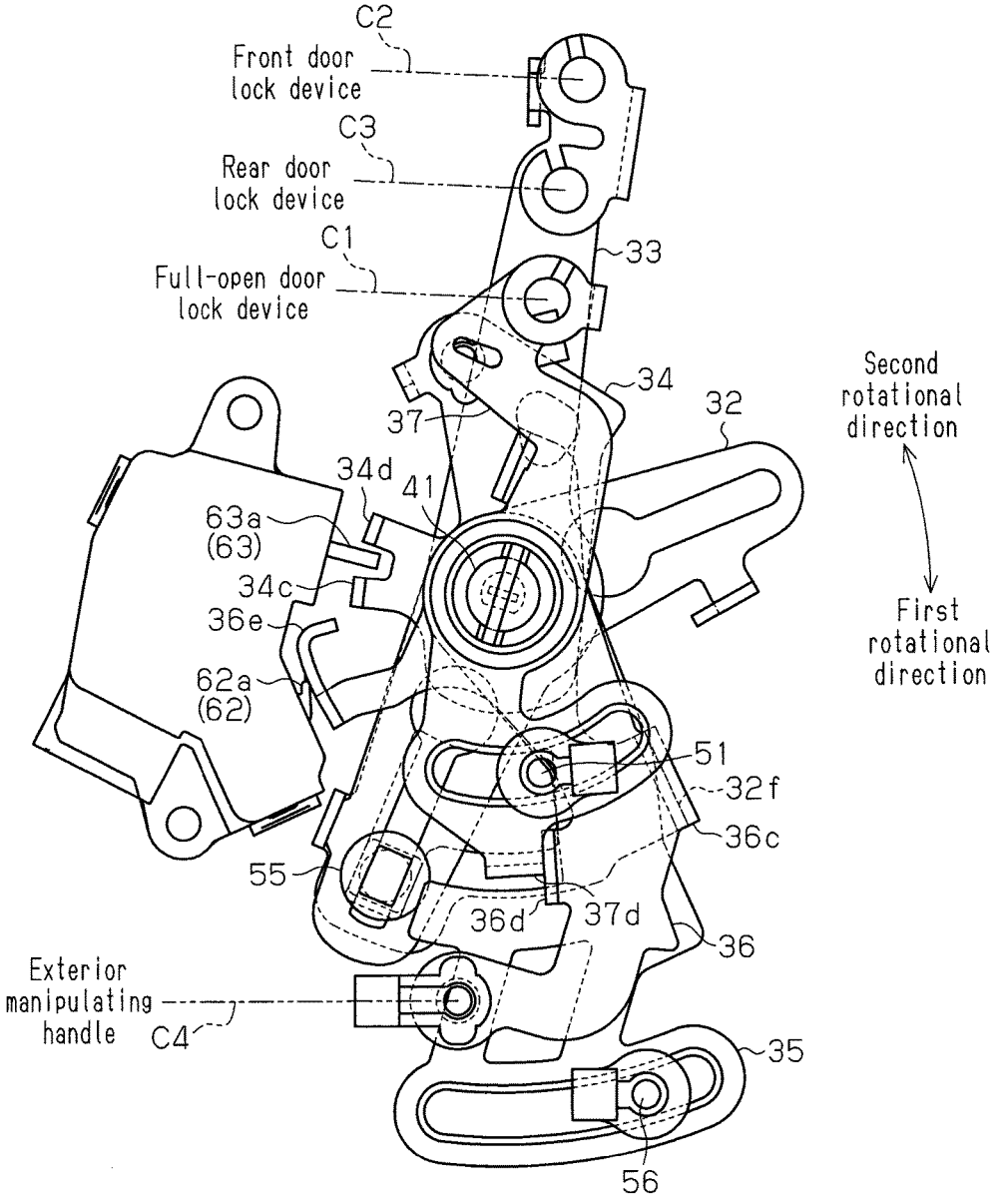
FIG. 7 is a front view of the remote control device of FIG. 3 in a state during manipulation of an exterior manipulating handle.

Also, when the exterior manipulating handle 3 is manipulated with the sliding door 2 being in the fully closed state or the fully open state, the cable C4 is pulled toward the remote controller 5 so that the exterior handle coupling lever 36 rotates in the first rotational direction as illustrated by the change from the state shown in FIG. 4 to the state shown in FIG. 7. In this process, the interlocking contact piece 36*c* presses the interlocking contact piece 32*f* of the opening lever 32 so that the opening lever 32 rotates integrally with the exterior handle coupling lever 36 in the first rotational direction. The rotation of the opening lever 32 is transmitted to the full-closure lock release lever 33 via the coupling pin 55. Together with the opening lever 32, the full-closure lock release lever 33 rotates integrally in the first rotational direction. The cables C2 and C3 are thereby pulled toward the remote controller 5. If the sliding door 2 is in the fully closed state, the front door lock device 6 and the rear door lock device 7 are released. The sliding door 2 is thus put in the openable state.

At the same time, the interlocking contact piece 36*d* presses the interlocking contact piece 37*d* of the full-open lock release lever 37 so that the full-open lock release lever 37 rotates integrally in the first rotational direction. The cable C1 is thereby pulled toward the remote controller 5 and if the sliding door 2 is in the fully open state, the full-open door lock device 8 is released. The sliding door 2 is thus put in the closable state.

Further, when, with the sliding door 2 being in the fully closed state or the fully open state, the release actuator 16 is activated by remote manipulation (manipulation of the remote control key or the centralized door lock button in the vehicle interior) without manipulation the exterior manipulating handle 3 or the interior manipulating handle 4, the cable C5 is pulled toward the release actuator 16 so that the power coupling lever 35 rotates in the first rotational direction as illustrated by the change from the state shown in FIG. 4 to the state shown in FIG. 8. In this process, the interlocking contact piece 35*c* presses the coupling pin 55 so that, via the coupling pin 55, the full-closure lock release lever 33 (and the opening lever 32) is rotated integrally with the power coupling lever 35 in the first rotational direction about the main support shaft 41 from the origin position. The cables C2 and C3 are thereby pulled toward the remote controller 5. If the sliding door 2 is in the fully closed state, the front door lock device 6 and the rear door lock device 7 are released. The sliding door 2 is thus put in the openable state.

At the same time, the interlocking contact piece 35*f* presses the full-open lock release lever 37 so that the full-open lock release lever 37 rotates integrally in the first rotational direction about the main support shaft 41 from the origin position. The cable C1 is thereby pulled toward the remote controller 5. If the sliding door 2 is in the fully open state, the full-open door lock device 8 is released. The sliding door 2 is thus put in the closable state.

The switch device 60 will now be described.

Figure 9B:
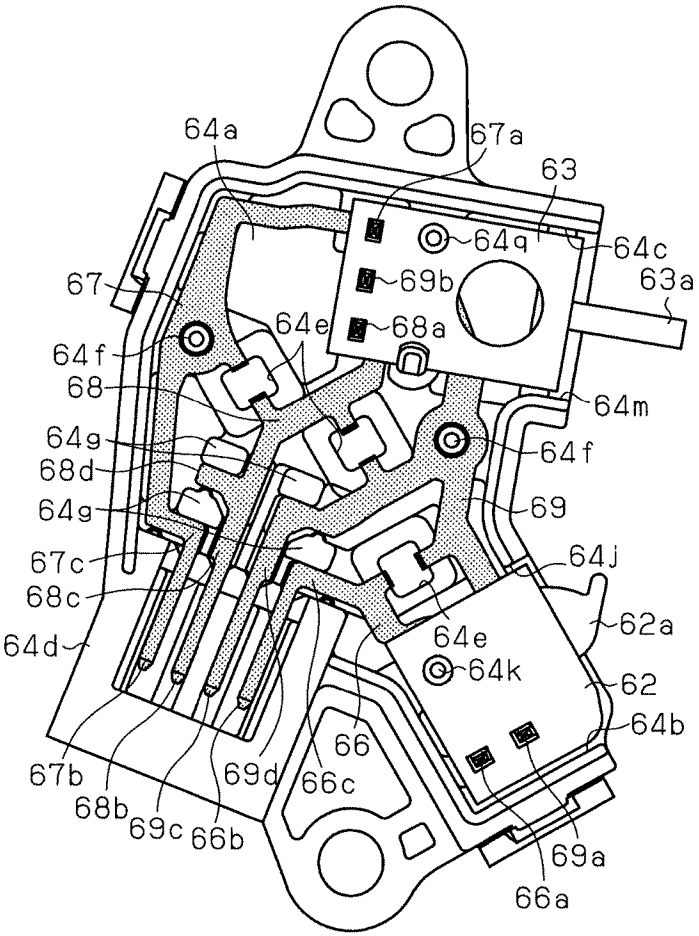
FIG. 9B is a front view of a body of the remote control device of FIG. 3.
Figure 9A:
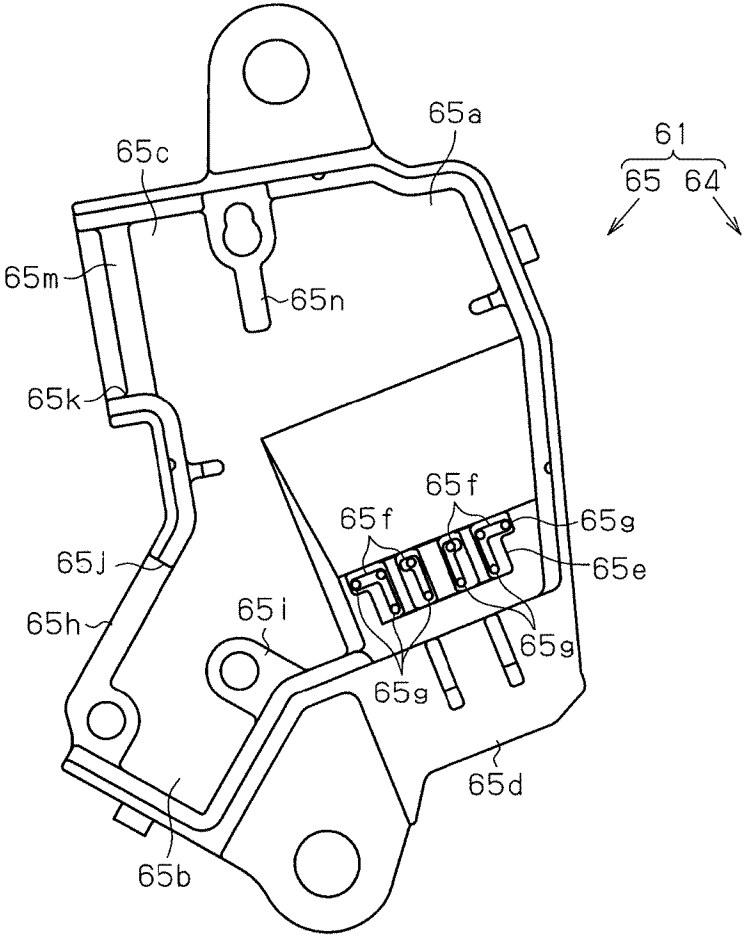
FIG. 9A is a rear view of a housing of the remote control device of FIG. 3.

As shown in FIGS. 9A and 9B, the case 61 of the switch device 60 has a two-part structure of a body 64 and a housing 65, which, for example, are substantially box-shaped and made of plastic. As shown in FIG. 9B, the body 64 has a wiring housing portion 64*a*, a first switch housing portion 64*b* arranged on the lower right side of the wiring housing portion 64*a*, a second switch housing portion 64*c* arranged on the right side of the wiring housing portion 64*a*, and a connector portion 64*d* arranged on the lower side of the wiring housing portion 64*a*. The wiring housing portion 64*a*, the first and second switch housing portions 64*b* and 64*c*, and the connector portion 64*d* are in mutual communication. Substantially the entirety of the body 64, excluding the tip portion of the connector portion 64*d*, is opened in a direction substantially orthogonal to the bottom wall (in the direction orthogonal to the sheet of the drawing and toward the viewer).

The wiring housing portion 64*a* has a plurality of (three) substantially rectangular recesses 64*e* formed to be recessed outward (in the direction orthogonal to the sheet of the drawing and away from the viewer) from its inner bottom surface. The wiring housing portion 64*a* also has a plurality of (two) substantially pin-shaped positioning projections 64*f* formed to project inward (in the direction orthogonal to the sheet of the drawing and toward the viewer) from the inner bottom surface and a plurality of (four) substantially pedestal-shaped guide projections 64*g* formed to project inward from the inner bottom surface adjacent to the connector portion 64*d*.

Figure 11:
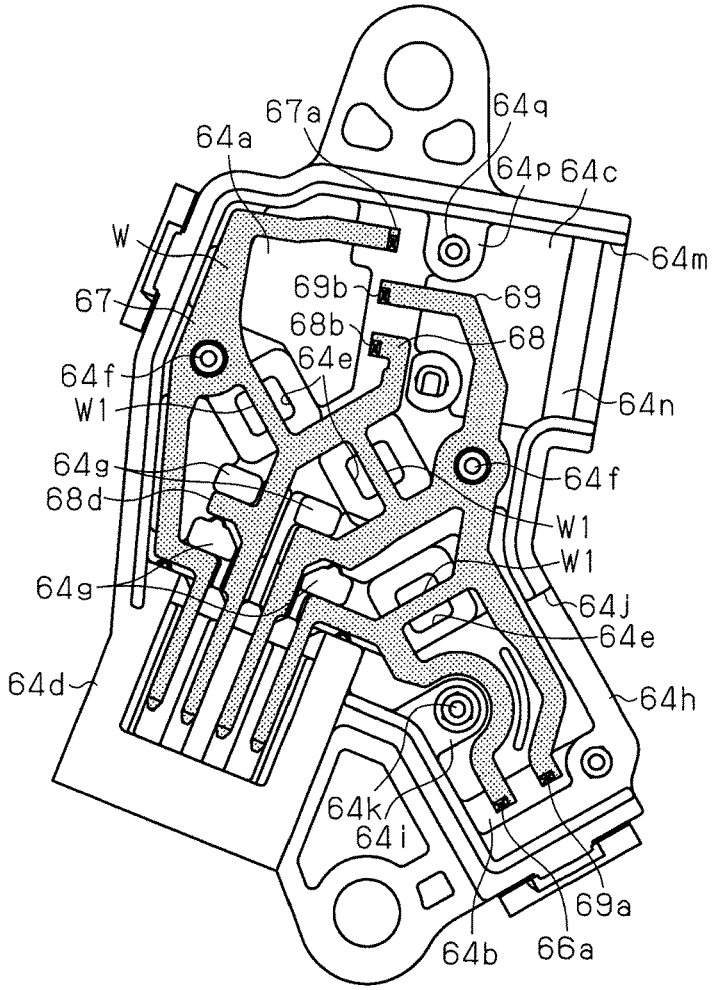
FIG. 11 is a front view of an assembly state of the switch device of FIG. 10.
Figure 12:
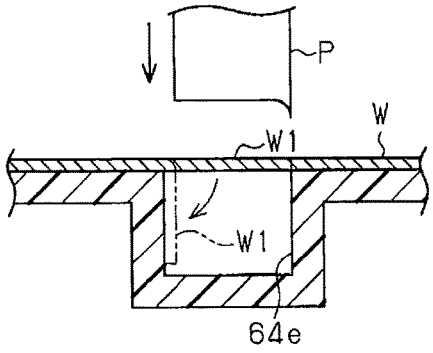
FIG. 12 is an explanatory drawing of a manner of processing the material of a lead frame.
Figure 13:
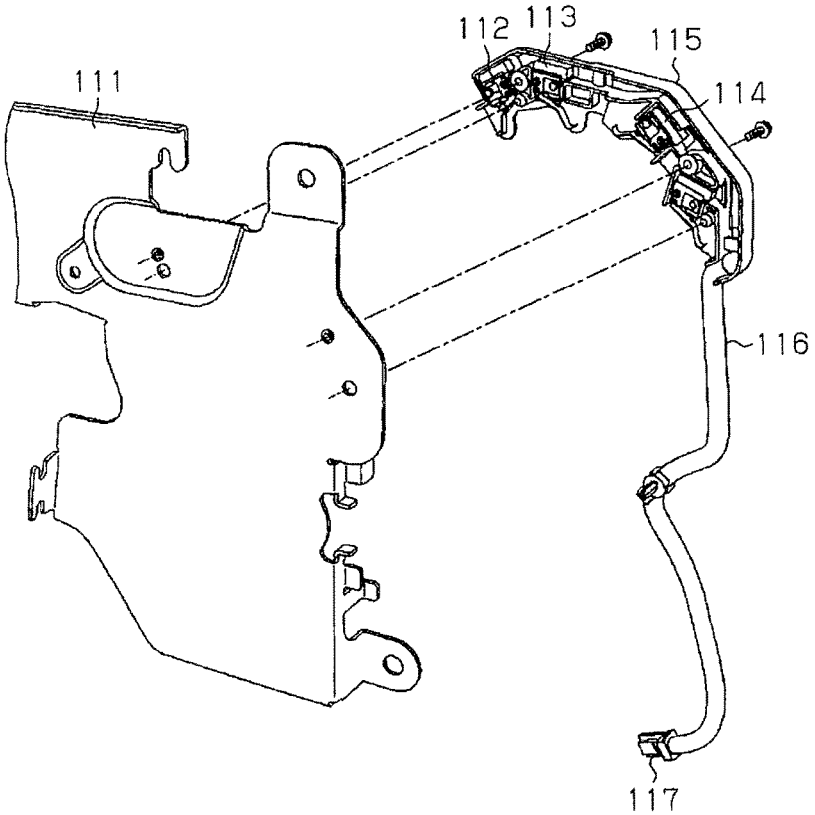
Fig.13 (Prior Art)
FIG. 13 is an exploded perspective view of a conventional structure.
Figure 14:
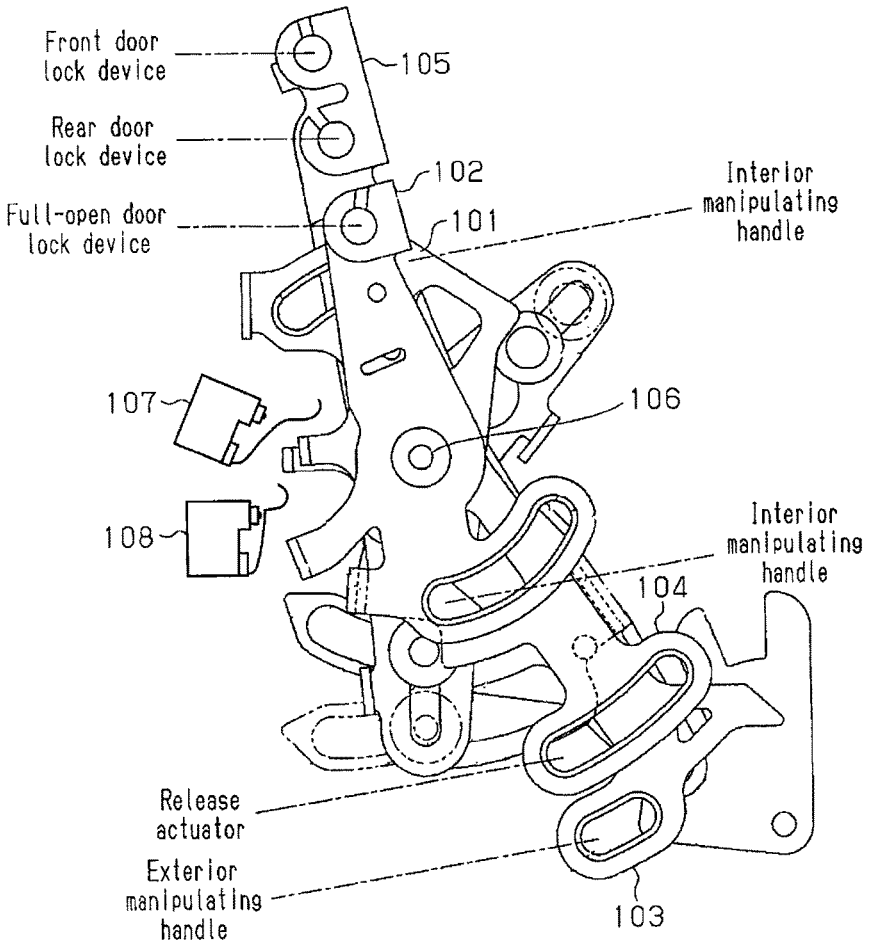
Fig.14 (Prior Art)
FIG. 14 is a front view of another conventional structure.

Also as shown in FIG. 11, the first switch housing portion 64*b* has a substantially L-shaped switch base portion 64*h* formed along its right side and lower side edge portions and has a substantially tongue-shaped switch base portion 64*i* formed at a portion adjacent to the connector portion 64*d*. The first switch housing portion 64*b* is opened in the right direction at a portion on the right side of the switch base portion 64*h* to form a first switch lever lead-out portion 64*j*. The switch base portion 64*i* has a substantially pin-shaped switch positioning projection 64*k* formed to project inward (in the direction orthogonal to the sheet of the drawing and toward the viewer).

The second switch housing portion 64*c* is opened in the right direction at a portion on the right side thereof to form a second switch lever lead-out portion 64*m*. The second switch housing portion 64*c* has a substantially I-shaped switch base portion 64*h*, which extends to cross the second switch lever lead-out portion 64*m*. The second switch housing portion 64*c* also has a substantially tongue-shaped switch base portion 64*p* formed at a portion adjacent to the wiring housing portion 64*a*. The switch base portion 64*p* has a substantially pin-shaped switch positioning projection 64*q* formed to project inward (in the direction orthogonal to the sheet of the drawing and toward the viewer).

In its entirety, the connector portion 64*d* is recessed outward (in the direction orthogonal to the sheet of the drawing and away from the viewer) relative to the inner bottom surface of the wiring housing portion 64*a*. The connector portion 64*d* has an inner wall surface corresponding to an outer shape of a connector (unillustrated) of an external device that is electrically connected to the switch device 60 and the tip portion thereof is substantially formed like a rectangular tube that opens substantially downward as viewed in the drawing.

As shown in FIG. 9B, lead frames 66, 67, 68, and 69, which are made of metal plates, are routed as a plurality of wiring members inside the body 64. The lead frames 66, 67, 68, and 69 are arranged to spread along the inner bottom surface (a single plane) of the body 64.

The lead frame 66 extends substantially along corner portions formed by the first switch housing portion 64*b* and the connector portion 64*d* and is placed and positioned on the inner bottom surface of the body 64 in a state of being sandwiched between the connector portion 64*d* and an opposing guide projection 64*g*.

At an end portion of the lead frame 66, which extends along a location corresponding to the exterior manipulating handle switch 62, a switch connection terminal 66*a*, which is electrically connected to a terminal of the exterior manipulating handle switch 62, is formed to bend and rise at a right angle toward the open side of the body 64 (in the direction orthogonal to the sheet of the drawing and toward the viewer). Also, a portion of the lead frame 66 extending inside the connector portion 64*d* forms an external connection terminal 66*b*, which extends along a connector guiding direction. The external connection terminal 66*b* is located at a position in the connector portion 64*d* closest to the first switch housing portion 64*b*.

In FIG. 9B, the lead frame 67 extends substantially along a left edge portion of the body 64 and a positioning projection 64*f* is inserted in a longitudinal direction middle portion of the lead frame 67. The lead frame 67 is placed and positioned on the inner bottom surface of the body 64 in a state of being sandwiched between the connector portion 64*d* and an opposing guide projection 64*g*.

At an end portion of the lead frame 67, which extends along a location corresponding to the interior manipulating handle switch 63, a switch connection terminal 67*a*, which is electrically connected to a terminal of the interior manipulating handle switch 63, is formed to bend and rise at a right angle toward the open side of the body 64 (in the direction orthogonal to the sheet of the drawing and toward the viewer). Also, a portion of the lead frame 67 extending inside the connector portion 64*d* forms an external connection terminal 67*b* that extends along the connector guiding direction. The external connection terminal 67*b* is located at a position in the connector portion 64*d* farthest from the first switch housing portion 64*b*.

The lead frame 68 is arranged adjacent to the lead frame 67 and has a substantially claw-shaped positioning piece 68*d*, which is sandwiched between the pair of guide protrusions 64*g*, which is arranged between the two lead frames 67 and 68. The lead frame 68 is placed and positioned on the inner bottom surface of the body 64 in a state where the positioning piece 68*d* is sandwiched between the two guide projections 64*g*.

At an end portion of the lead frame 68 that extends along a location corresponding to the interior manipulating handle switch 63, a switch connection terminal 68*a*, which is electrically connected to a terminal of the interior manipulating handle switch 63, is formed to bend and rise at a right angle toward the open side of the body 64 (in the direction orthogonal to the sheet of the drawing and toward the viewer). Also, a portion of the lead frame 68 extending inside the connector portion 64*d* forms an external connection terminal 68*b*, which extends along the connector guiding direction. The external connection terminal 68*b* is arranged adjacent to the external connection terminal 67*b* in the connector portion 64*d*.

The lead frame 69 is branched into three lines and has a portion extending substantially along a right edge portion of the body 64 in FIG. 9B and a portion branching from a longitudinal direction middle portion of the aforementioned portion and extending between the lead frames 66 and 68. A positioning projection 64*f* is inserted in the middle portion that is the branching location of the lead frame 69. The lead frame 69 is placed and positioned on the inner bottom surface of the body 64 in a state of being sandwiched between a pair of guide projections 64*g*.

At an end portion of the lead frame 69, which extends along a location corresponding to the exterior manipulating handle switch 62, a switch connection terminal 69*a*, which is electrically connected to a terminal of the exterior manipulating handle switch 62, is formed to bend and rise at a right angle toward the open side of the body 64 (in the direction orthogonal to the sheet of the drawing and toward the viewer). Also at an end portion of the lead frame 69, which extends along a location corresponding to the interior manipulating handle switch 63, a switch connection terminal 69*b*, which is electrically connected to a terminal of the interior manipulating handle switch 63, is formed to bend and rise at a right angle toward the open side of the body 64 (in the direction orthogonal to the sheet of the drawing and toward the viewer). Further, a portion of the lead frame 69 extending inside the connector portion 64*d* forms an external connection terminal 69*c* that extends along the connector guiding direction. The external connection terminal 69*c* is located between the two external connection terminals 66*b* and 68*b* in the connector portion 64*d*.

The recesses 64*e* are respectively located between adjacent lead frames among the lead frames 66 to 69.

In the state where the switch positioning projection 64*k* is inserted, the exterior manipulating handle switch 62 is placed and positioned on the switch base portions 64*h* and 64*i* of the body 64. The exterior manipulating handle switch 62 is electrically connected to the lead frames 66 and 69 via the switch connection terminals 66*a* and 69*a*. Also, the switch lever 62*a* is led out from the first switch lever lead-out portion 64*j*.

Similarly, in the state where the switch positioning projection 64*q* is inserted, the interior manipulating handle switch 63 is placed and positioned on the switch base portions 64*n* and 64*p* of the body 64. The interior manipulating handle switch 63 is electrically connected to the lead frames 67, 68, and 69 via the switch connection terminals 67*a*, 68*a*, and 69*a*. Also, the switch lever 63*a* is led out from the second switch lever lead-out portion 64*m*.

The external connection terminal 69*c* of the lead frame 69, which is used in common by the exterior manipulating handle switch 62 and the interior manipulating handle switch 63, functions as a ground terminal.

As shown in FIG. 9A, the housing 65 is formed substantially in accordance with the outer shape of the body 64 and by being fitted onto the body 64, coacts with the body 64 to hold the exterior manipulating handle switch 62, the interior manipulating handle switch 63, and the lead frames 66 to 69.

That is, the housing 65 has a wiring housing portion 65*a*, a first switch housing portion 65*b* arranged on the lower left side of the wiring housing portion 65*a*, a second switch housing portion 65*c* arranged on the left side of the wiring housing portion 65*a*, and a connector cover portion 65*d* arranged on the lower side of the wiring housing portion 65*a*. The wiring housing portion 65*a* and the first and second switch housing portions 65*b* and 65*c* are in mutual communication. The entirety of the housing 65 is opened in a direction orthogonal to the bottom wall (in the direction orthogonal to the sheet of the drawing and toward the viewer).

The wiring housing portion 65*a* has a base portion 65*e* formed to project inward (in the direction orthogonal to the sheet of the drawing and toward the viewer) from an inner bottom surface adjacent to the connector cover portion 65*d*. A plurality of (four) substantially L-shaped holding projections 65*f*, which is arranged in parallel on the base portion 65*e*, projects from the base portion 65*e*. Further, a plurality of substantially hemispherical pressing portions 65*g* projects from each holding projection 65*f*. The holding projections 65*f* correspond to root portions 66*c*, 67*c*, 68*c*, and 69*d* of the external connection terminals 66*b*, 67*b*, 68*b*, and 69*c* of the lead frames 66 to 69 located on the inner bottom surface of the body 64.

When the housing 65 is fitted onto the body 64, the pressing portions 65*g* of the respective holding projections 65*f* are pressed against the root portions 66*c*, 67*c*, 68*c*, and 69*d* of the corresponding external connection terminals 66*b*, 67*b*, 68*b*, and 69*c* to firmly clamp the root portions 66*c*, 67*c*, 68*c*, and 69*d* with the inner bottom surface of the body 64.

As shown in FIG. 9A, the first switch housing portion 65*b* has a substantially I-shaped switch base portion 65*h* formed along its left side edge portion and has a substantially tongue-shaped switch base portion 65*i* formed at a portion adjacent to the connector cover portion 65*d*. The first switch housing portion 65*b* is opened in the left direction at the switch base portion 65*h* to form a first switch lever lead-out portion 65*j*. When the housing 65 is fitted onto the body 64, the switch base portions 65*h* and 65*i*, in conjunction with the opposing switch base portions 64*h* and 64*i* of the body 64, sandwich and thereby hold the exterior manipulating handle switch 62. In this state, the first switch lever lead-out portion 65*j* of the housing 65 and the first switch lever lead-out portion 64*j* of the body 64 form an opening that allows the switch lever 62*a* of the exterior manipulating handle switch 62 to be led out to the exterior.

The second switch housing portion 65*c* is opened in the left direction at a portion on the left side thereof to form a second switch lever lead-out portion 65*k*. The second switch housing portion 65*c* has a substantially I-shaped switch base portion 65*m*, which extends to cross the second switch lever lead-out portion 65*k*. The second switch housing portion 65*c* also has a substantially tongue-shaped switch base portion 65*n* formed at a portion adjacent to the wiring housing portion 65*a*. When the housing 65 is fitted onto the body 64, the switch base portions 65*m* and 65*n*, in conjunction with the opposing switch base portions 64*n* and 64*p* of the body 64, sandwich and thereby hold the interior manipulating handle switch 63. In this state, the second switch lever lead-out portion 65*k* of the housing 65 and the second switch lever lead-out portion 64*m* of the body 64 form an opening that allows the switch lever 63*a* of the interior manipulating handle switch 63 to be led out to the exterior.

The connector cover portion 65*d* has substantially a flat plate shape that spreads substantially along the bottom wall of the body 64 (connector portion 64*d*) and covers the opening of the connector portion 64*d* when the housing 65 is fitted onto the body 64. The connector cover portion 65*d* and the connector portion 64*d* form a substantially rectangular connector inlet that opens in the connector guiding direction (direction of extension of the external connection terminals 66*b*, 67*b*, 68*b*, and 69*b*). A connector of the external device that is electrically connected to the switch device 60 is thus held in a state where its entire periphery is fitted to the connector portion 64*d* and connector cover portion 65*d* upon being inserted into the connector inlet along the connector guiding direction. In this state, the connector of the external device is electrically connected to the external connection terminals 66*b*, 67*b*, 68*b*, and 69*c*.

An equivalent circuit of the switch device 60 will now be described.

Figure 10:
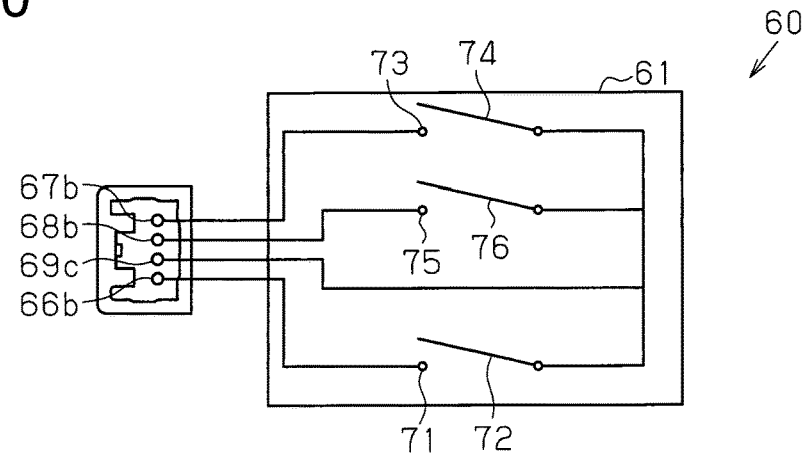
FIG. 10 is an equivalent circuit diagram of a switch device of the remote control device of FIG. 3.

As shown in FIG. 10, the exterior manipulating handle switch 62 of the switch device 60 has a fixed terminal 71 electrically connected to the external connection terminal 66*b* and a movable terminal 72 electrically connected to the external connection terminal (ground terminal) 69*c*. The movable terminal 72 is linked to the switch lever 62*a*. That is, when the movable terminal 72 is made to contact the fixed terminal 71 by the swinging of the switch lever 62*a* in accordance with the manipulation of the exterior manipulating handle 3, the exterior manipulating handle switch 62 switches to the ON state.

In contrast, the interior manipulating handle switch 63 has a fixed terminal 73 electrically connected to the external connection terminal 67*b* and a movable terminal 74 electrically connected to the external connection terminal 69*c*. Also, the interior manipulating handle switch 63 has a fixed terminal 75 electrically connected to the external connection terminal 68*b* and a movable terminal 76 electrically connected to the external connection terminal 69*c*. The movable terminals 74 and 76 are linked to the switch lever 63*a*. That is, when the movable terminal 74 is made to contact the fixed terminal 73 by the swinging of the switch lever 63*a* in the first direction in accordance with the opening manipulation of the interior manipulating handle 4, the interior manipulating handle switch 63 switches to the first ON state. When the movable terminal 76 is made to contact the fixed terminal 75 by the swinging of the switch lever 63*a* in the second direction (opposite direction of the first direction) in accordance with the closing manipulation of the interior manipulating handle 4, the interior manipulating handle switch 63 switches to the second ON state In other words, the switch device 60 has a function of switching in accordance with manipulation of the exterior manipulating handle 3 or the interior manipulating handle 4 and a function of connection with the external device.

A manner of assembly of the switch device 60 will now be described.

As shown in FIG. 11, a material W of the lead frames 66 to 69 is housed in the body 64. The material W is a single, continuous plate material that is formed in accordance with the overall outer shape of the lead frames 66 to 69. This is done to avoid complication of assembly of the lead frames 66 to 69 individually onto the body 64. In FIG. 11, the same symbols as the symbols provided to the lead frames 66 to 69 are provided to respective portions of the material W corresponding to the lead frames 66 to 69 for the sake of convenience.

As mentioned above, substantially the entirety of the body 64 is opened in a direction substantially orthogonal to the bottom wall (in the direction orthogonal to the sheet of FIG. 11 and toward the viewer) and the material W is housed in the body 64 by being assembled in a single direction onto the inner bottom surface of the body 64. In this process, the positioning projections 64*f* are inserted into the material W and the material W is guided by the guide projections 64*g* so that the material W is positioned appropriately on the inner wall surface of the body 64.

The material W has connecting pieces W1 extending above the recesses 64*e* and between adjacent lead frames among the lead frame 66 to 69. With the material W, the lead frames 66 to 69 are short-circuited via the connecting pieces W1.

In this state, the exterior manipulating handle switch 62 and the interior manipulating handle switch 63 are housed in the body 64. The exterior manipulating handle switch 62 and the interior manipulating handle switch 63 are also housed in the body 64 by being assembled in a single direction onto the inner bottom surface of the body 64. In this process, the orientation of the material W on the inner bottom surface of the body 64 is held provisionally by the switch connection terminals 66*a* and 69*a* being inserted into the exterior manipulating handle switch 62 and the switch connection terminals 67*a*, 68*a*, and 69*b* being inserted into the interior manipulating handle switch 63.

When a punch P of a press machine is lowered toward the bottom wall of the body 64 from above each recess 64*e*, one end of the connecting piece W1 is cut and the connecting piece W1 is bent into the recess 64*e* with the other end of the connecting piece W1 as a pivot as the punch P enters into the recess 64*e*. The material W is thereby separated into four parts to form the lead frames 66 to 69 while its orientation on the inner bottom surface of the body 64 is provisionally held.

When the housing 65 is thereafter fitted onto the body 64, the pressing portions 65*g* of the respective holding projections 65*f* and the inner bottom surface of the body 64 clamp the root portions 66*c*, 67*c*, 68*c*, and 69*d* of the corresponding external connection terminals 66*b*, 67*b*, 68*b*, and 69*c*. At the same time, the exterior manipulating handle switch 62 is sandwiched between the switch base portions 65*h* and 65*i* and the switch base portions 64*h* and 64*i*, and the interior manipulating handle switch 63 is sandwiched between the switch base portions 65*m* and 65*n* and the switch base portions 64*n* and 64*p*. The assembly of the switch device 60 is thus completed in the state where the exterior manipulating handle switch 62, the interior manipulating handle switch 63, and the lead frames 66 to 69 are held inside the case 61 that includes the body 64 and the housing 65.

The present embodiment has the following advantages.

(1) With the present embodiment, the interior manipulating handle switch (interior manipulation detector) 63, which detects rotation of the interior handle coupling lever 34, the exterior manipulating handle switch (exterior manipulation detector) 62, which detects rotation of the exterior handle coupling lever 36, and the lead frames (wiring members) 66 to 69 are housed inside the body 64. The external connection terminals 66*b*, 67*b*, 68*b*, and 69*c* of all of the lead frames 66 to 69 are surrounded by the connector portion 64*d*. The body 64 is covered by the housing 65. In this case, the interior manipulating handle switch 63 or the exterior manipulating handle switch 62 is electrically connected to the switch connection terminals, among the switch connection terminals (detector connection terminals) 66*a*, 67*a*, 68*a*, 69*a*, and 69*b*, which are of the corresponding lead frames among the lead frames 66 to 69 and thereby electrically connected to the corresponding external connection terminals among the external connection terminals 66*b*, 67*b*, 68*b*, and 69*c* surrounded by the connector portion 64*d* (and the connector cover portion 65*d*). The interior manipulating handle switch 63 or the exterior manipulating handle switch 62 can thus be electrically connected to the external device at the respectively corresponding external connection terminals among the external connection terminals 66*b*, 67*b*, 68*b*, and 69*c* by the appropriate connector of the external device attached to the connector portion 64*d*. A step of connecting a terminal on one side of an electric wire to a terminal of an interior manipulating handle switch or an exterior manipulating handle switch and connecting a terminal on the other side of the electric wire to a corresponding external connection terminal as in the conventional example is thus made unnecessary. The manufacturing steps are thus reduced.

(2) With the present embodiment, the body 64 has an arrangement region in which the lead frames 66 to 69 are arranged, and the lead frames 66 to 69 are arranged in the arrangement region to spread along a single plane. The arrangement region is opened in a direction substantially orthogonal to the single plane along which the lead frames 66 to 69 spread. Therefore, the lead frames 66 to 69 can be assembled smoothly onto the body 64 by simply moving these toward the body 64 in the direction substantially orthogonal to the single plane along which these spread (that is, in the direction in which the body 64 is opened).

(3) With the present embodiment, the holding projections 65*f* of the housing 65 and the body 64 clamp the root portions 66*c*, 67*c*, 68*c*, and 69*d* of the external connection terminals 66*b*, 67*b*, 68*b*, and 69*c* to enable suppression of looseness of the external connection terminals 66*b*, 67*b*, 68*b*, and 69*c*. The connector of the external device attached to the connector portion 64*d* (and the connector cover portion 65*d*) and the external connection terminals 66*b*, 67*b*, 68*b*, and 69*c* are thereby electrically connected more smoothly.

(4) With the present embodiment, in conjunction with the body 64, the holding projections 65*f* clamp the root portions 66*c*, 67*c*, 68*c*, and 69*d* of the external connection terminals 66*b*, 67*b*, 68*b*, and 69*c* with forces being concentrated at the pressing portions 65*g*. Looseness of the external connection terminals 66*b*, 67*b*, 68*b*, and 69*c* can thus be suppressed further.

(5) With the present embodiment, the interior manipulating handle switch 63 and the exterior manipulating handle switch 62 are arranged collectively at a single location. That is, modularization of the switch device 60 is realized by housing the interior manipulating handle switch 63, the exterior manipulating handle switch 62, in the common case 61 (body 64 and housing 65). Ease of assembly and reduction of assembly steps can thereby be achieved and therefore cost can be reduced. Also, consideration of dustproofing in regard to the switches 62 and 63 can be alleviated to enable adoption of switches with non-waterproof specifications and therefore reduce cost.

(6) With the present embodiment, the interior manipulating handle switch 63 is a single switch capable of detecting rotations of the interior handle coupling lever 34 in two directions, in other words, both the opening manipulation and the closing manipulation of the interior manipulating handle 4. The number of parts and cost are thus reduced. The case 61 for housing the interior manipulating handle switch 63 is also made more compact.

(7) With the present embodiment, when the interior manipulating handle 4 is manipulated for opening, the interior handle coupling lever 34 rotates in the first rotational direction. This rotation in the first direction, that is, the opening manipulation of the interior manipulating handle 4 is detected by the interior manipulating handle switch 63. In this process, the exterior handle coupling lever 36 and the power coupling lever 35, which are independent from the interior handle coupling lever 34, do not operate and the exterior manipulating handle switch 62 does not perform the detection operation.

Also when the interior manipulating handle 4 is manipulated for closing, the interior handle coupling lever 34 rotates in the second rotational direction. This rotation in the second direction, that is, the closing manipulation of the interior manipulating handle 4 is detected by the interior manipulating handle switch 63. In this process, the exterior handle coupling lever 36 and the power coupling lever 35, which are independent from the interior handle coupling lever 34, do not operate and the exterior manipulating handle switch 62 does not perform the detection operation.

Further, when the exterior manipulating handle 3 is manipulated, the exterior handle coupling lever 36 rotates. This rotation, that is, the manipulation of the exterior manipulating handle 3 is detected by the exterior manipulating handle switch 62. In this process, the interior handle coupling lever 34 and the power coupling lever 35, which are independent from the exterior handle coupling lever 36, do not operate and the interior manipulating handle switch 63 does not perform the detection operation.

In contrast, when the release actuator 16 is activated, the power coupling lever 35 rotates. In this process, the interior handle coupling lever 34 and the exterior handle coupling lever 36, which are independent from the power coupling lever 35, do not operate and neither the exterior manipulating handle switch 62 nor the interior manipulating handle switch 63 performs the detection operation. That is, even when the release actuator 16 is being activated, the respective switches 62 and 63 can detect the manipulations of the corresponding manipulating handles 4 and 3. The need to disable reception of the detection results during the activation of the release actuator to prevent erroneous operation is thus eliminated.

Therefore, even during the activation of the release actuator 16, the respective switches 63 and 62 detect the manipulations of the corresponding manipulating handles 4 and 3 to enable quick interruption of the opening or closing of the sliding door 2 by the electrically-powered door opening/closing device 9.

(8) With the present embodiment, if the interior manipulating handle 4 is manipulated for opening when the locking lever 38 is at the unlock position, the interior handle coupling lever 34 rotates and the opening lever 32 rotates accordingly. This rotation of the opening lever 32 is transmitted via the coupling pin 55 to the full-closure lock release lever 33 to release the front door lock device 6 and the rear door lock device 7. The sliding door 2 is thus put in the openable state (unlocked state). Similarly, if the exterior manipulating handle 3 is manipulated when the locking lever 38 is at the unlock position, the exterior handle coupling lever 36 rotates and the opening lever 32 rotates accordingly. This rotation of the opening lever 32 is transmitted via the coupling pin 55 to the full-closure lock release lever 33 to release the front door lock device 6 and the rear door lock device 7. The sliding door 2 is thus put in the openable state (unlocked state).

In contrast, if the interior manipulating handle 4 is manipulated for opening when the locking lever 38 is at the lock position, the interior handle coupling lever 34 rotates and the opening lever 32 rotates accordingly. However, this rotation of the opening lever 32 is not transmitted to the full-closure lock release lever 33 and the front door lock device 6 and the rear door lock device 7 are not released (locked state). Similarly, if the exterior manipulating handle 3 is manipulated when the locking lever 38 is at the lock position, the exterior handle coupling lever 36 rotates and the opening lever 32 rotates accordingly. However, this rotation of the opening lever 32 is not transmitted to the full-closure lock release lever 33 and the front door lock device 6 and the rear door lock device 7 are not released (locked state).

With the above, regardless of the unlocked state/locked state of the sliding door 2, when the interior manipulating handle 4 is manipulated for opening, the interior handle coupling lever 34 is rotated accordingly and this rotation, that is, the opening manipulation of the interior manipulating handle 4 can be detected by the interior manipulating handle switch 63. Similarly, regardless of the unlocked state/locked state of the sliding door 2, when the exterior manipulating handle 3 is manipulated, the exterior handle coupling lever 36 is rotated accordingly and this rotation, that is, the manipulation of the exterior manipulating handle 3 can be detected by the exterior manipulating handle switch 62.

(9) With the present embodiment, if the interior manipulating handle 4 is manipulated for opening in the state where the child lock pin 54 is arranged at the child-lock unlock position by the child lock manipulating portion 39, the interior handle coupling lever 34 rotates and this rotation is transmitted via the child lock pin 54 to the opening lever 32 to make the opening lever 32 rotate. If in this process, the sliding door 2 is in the unlocked state, rotation of the opening lever 32 is transmitted to the full-closure lock release lever 33 to release the front door lock device 6 and the rear door lock device 7. The sliding door 2 is thus put in the openable state (so-called child-lock unlocked state).

In contrast, if the interior manipulating handle 4 is manipulated for opening in the state where the child lock pin 54 is arranged at the child-lock lock position by the child lock manipulating portion 39, although the interior handle coupling lever 34 rotates, this rotation is not transmitted to the opening lever 32 and the front door lock device 6 and the rear door lock device 7 are not released. That is, regardless of the unlocked state/locked state of the sliding door 2, the putting of the sliding door 2 in the openable state by the opening manipulation of the interior manipulating handle 4 is disabled (so-called child-lock locked state).

With the above, regardless of the child-lock unlocked state/child-lock locked state, when the interior manipulating handle 4 is manipulated for opening, the interior handle coupling lever 34 is rotated accordingly and this rotation, that is, the opening manipulation of the interior manipulating handle 4 can be detected by the interior manipulating handle switch 63.

(10) With the present embodiment, the interior handle coupling lever 34 is directly connected (without lost motion setting) to the link 53 extending from the interior manipulating handle 4 to make the interior handle coupling lever 34 rotate in directions respectively corresponding to the opening manipulation and the closing manipulation of the interior manipulating handle 4. The opening manipulation and the closing manipulation of the interior manipulating handle 4 can thus be detected just through the operation of the interior handle coupling lever 34.

(11) With the present embodiment, the manipulation of the exterior manipulating handle 3, the opening manipulation and the closing manipulation of the interior manipulating handle 4, and the activation of the release actuator 16 can be distinguished by the exterior manipulating handle switch 62 and the interior manipulating handle switch 63. Therefore, for example, mechanical opening and closing, electrical opening and closing, and input source during actuation can be determined to enable more detailed actuation state analysis and malfunction determination to be performed.

(12) With the present embodiment, the manipulation of the exterior manipulating handle 3 and the opening manipulation and the closing manipulation of the interior manipulating handle 4 can be distinguished by the exterior manipulating handle switch 62 and the interior manipulating handle switch 63 and therefore, for example, an operation, which is performed when manipulation that follows the sliding door 2 being put in an intermediately stopped state is detected, can be controlled finely. For example, when intermediate stoppage is performed during the sliding door 2 opening actuation by the electrically-powered door opening/closing device 9, the electrically-powered door opening/closing device 9 can be made to perform actuation (that is, closing actuation) that is reverse the previous actuation upon detection of manipulation of the exterior manipulating handle 3.

The above described embodiment may be modified as follows.

- Although with the embodiment, rotations of the interior handle coupling lever 34 in the two directions, that is, the opening manipulation and the closing manipulation of the interior manipulating handle 4 are detected just by the interior manipulating handle switch 63, a configuration is also possible where rotations of the interior handle coupling lever 34 in the two directions are detected individually by two switches.
- With the embodiment, if the operation of the exterior manipulating handle 3 differs between an opening manipulation and a closing manipulation, the opening manipulation and the closing manipulation of the exterior manipulating handle 3 may be detected respectively.
- With the embodiment, a suitable rotation sensor capable of detecting rotation position of the exterior handle coupling lever 36 may be adopted in place of the exterior manipulating handle switch 62. Similarly, a suitable rotation sensor capable of detecting rotation position of the interior handle coupling lever 34 may be adopted in place of the interior manipulating handle switch 63.
- With the embodiment, the pressing portions 65*g* of the holding projections 65*f* may be omitted, and the root portions 66*c*, 67*c*, 68*c*, and 69*d* of the external connection terminals 66*b*, 67*b*, 68*b*, and 69*c* may be clamped directly by the holding projections 65*f*.
- With the embodiment, the holding projections 65*f* may be omitted. In this case, a suitable guide means is preferably provided to suppress looseness of the external connection terminals 66*b*, 67*b*, 68*b*, and 69*c*.

With the embodiment, the body 64, with which the arrangement region for the lead frames 66 to 69 (material W) is opened in the direction substantially orthogonal to the plane along which the lead frames 66 to 69 spread, is adopted. In this regard, the arrangement region for the lead frames 66 to 69 may be opened in any direction intersecting the plane along which the lead frames 66 to 69 spread as long as the arrangement region can be opened.

Also, with the body 64, the arrangement region for the lead frames 66 to 69 does not necessarily have to be opened. For example, the connector portion (64*d*) of the body 64 may be of a cylindrical form that surrounds the entirety of the external connection terminals 66*b*, 67*b*, 68*b*, and 69*c* and is opened in the connector guiding direction. In this case, the connector cover portion (65*d*) of the housing 65 may be omitted.

With the embodiment, all of the opening lever 32, the full-closure lock release lever 33, the interior handle coupling lever 34, the power coupling lever 35, the exterior handle coupling lever 36, and the full-open lock release lever 37 are arranged on the same axis. However at least one of the opening lever 32, the full-closure lock release lever 33, the interior handle coupling lever 34, the power coupling lever 35, the exterior handle coupling lever 36, and the full-open lock release lever 37 may be arranged on an axis that differs from that of the others. Also in this case, there is no need for the opening lever 32, the full-closure lock release lever 33, the power coupling lever 35, the exterior handle coupling lever 36, and the full-open lock release lever 37 to be matched in the direction of rotation from the origin position.

The invention claimed is:

1. A remote control device for a vehicle, comprising:

a baseplate configured to be fixed on a vehicle door;

an interior handle coupling lever that is supported on the baseplate and configured to rotate in accordance with manipulation of an interior manipulating handle to release a first door lock device, which holds the vehicle door in a fully closed state, or a second door lock device, which holds the vehicle door in a fully open state;

an exterior handle coupling lever that is supported on the baseplate and configured to rotate in accordance with manipulation of an exterior manipulating handle to release the first door lock device or the second door lock device; and a switch device supported on the baseplate, wherein the switch device includes an interior manipulation detector that detects rotation of the interior handle coupling lever, an exterior manipulation detector that detects rotation of the exterior handle coupling lever, a plurality of wiring members, each having a detector connection terminal and an external connection terminal that are electrically connected to the interior manipulation detector or the exterior manipulation detector, a body that houses the interior manipulation detector, the exterior manipulation detector, and the wiring members and has a connector portion that surrounds all the external connection terminals of the wiring members, and a housing that covers the body, wherein the exterior manipulation detector includes a first lever to which rotation of the exterior handle coupling lever is transmitted, wherein the interior manipulation detector includes a second lever to which rotation of the interior handle coupling lever is transmitted, wherein the body and the housing each include a first opening-defining portion that holds the exterior manipulation detector therein and defines a first opening, the first lever extends from a position within the first opening to a position outside of the first opening and beyond an exterior of the body and the housing, wherein the body and the housing each include a second opening-defining portion that holds the interior manipulation detector therein and defines a second opening, the second lever extends from a position within the second opening to a position outside of the second opening and beyond the exterior of the body and the housing, wherein the interior handle coupling lever defines an opening depressing portion and a closing depressing portion, the interior handle coupling lever is configured to rotate in a first direction in accordance with opening manipulation of the interior manipulating handle and rotate in a second direction opposite to the first direction in accordance with closing manipulation of the interior manipulating handle, wherein the interior manipulation detector comprises a switch lever configured to be received between the opening depressing portion and the closing depressing portion and configured to pivot between a neutral position and a respective one of the first and second directions to detect both opening and closing manipulation of the interior manipulation handle, and wherein the switch lever is configured to contact the opening depressing portion when the interior handle coupling lever is rotated in the first direction, and the switch lever is configured to contact the closing depressing portion when the interior handle coupling lever is rotated in the second direction.

2. The remote control device for a vehicle according to claim 1, wherein the body has an arrangement region in which the wiring members are arranged, the wiring members are arranged in the arrangement region to spread along a single plane, and the arrangement region is opened in a direction intersecting the single plane.

3. The remote control device for a vehicle according to claim 1, wherein the housing has a holding projection that projects toward the body and clamps, in conjunction with the body, a root portion of each of the external connection terminals.

4. The remote control device for a vehicle according to claim 3, wherein the holding projection has a pressing portion that is pressed against the root portion of each of the external connection terminals.

5. The remote control device for a vehicle according to claim 1, wherein the interior handle coupling lever is configured to rotate in a first direction in accordance with opening manipulation of the interior manipulating handle to release the first door lock device and rotate in a second direction opposite to the first direction in accordance with closing manipulation of the interior manipulating handle to release the second door lock device, the exterior handle coupling lever is configured to rotate independently from the interior handle coupling lever and in accordance with manipulation of the exterior manipulating handle to release the first door lock device or the second door lock device, the remote control device for a vehicle further comprises a power coupling lever configured to be linked to a release actuator, the power coupling lever is configured to rotate independently from the interior handle coupling lever and the exterior handle coupling lever and by a drive force of the release actuator to release the first door lock device or the second door lock device, and the interior manipulation detector includes an interior opening manipulation detector that detects rotation of the interior handle coupling lever in the first direction and an interior closing manipulation detector that detects rotation of the interior handle coupling lever in the second direction.

6. The remote control device for a vehicle according to claim 5, further comprising:

a relay lever that is linked to the interior handle coupling lever and the exterior handle coupling lever and configured to rotate in accordance with rotation of the interior handle coupling lever in the first direction and to rotate in accordance with rotation of the exterior handle coupling lever;

a full-closure lock release lever configured to be linked to the first door lock device; and a locking lever that is linked to the relay lever and configured to be capable of being selectively located at an unlock position and a lock position, wherein the locking lever is configured to enable transmission of rotation of the relay lever to the full-closure lock release lever when at the unlock position and disable transmission of rotation of the relay lever to the full-closure lock release lever when at the lock position.

7. The remote control device for a vehicle according to claim 6, further comprising:

a child lock member movably supported on the relay lever; and a child lock manipulating portion that is linked to the child lock member and capable of being manipulated to selectively arrange the child lock member at a child-lock unlock position within a rotation range of the interior handle coupling lever and an child-lock lock position outside the rotation range of the interior handle coupling lever, wherein the child lock member is configured to enable transmission of rotation of the interior handle coupling lever in the first direction to the relay lever when at the child-lock unlock position and disable transmission of rotation of the interior handle coupling lever to the relay lever when at the child-lock lock position.

8. The remote control device for a vehicle according to claim 5, wherein the interior opening manipulation detector and the interior closing manipulation detector are configured by a single switch capable of detecting both rotation in the first direction and rotation in the second direction of the interior handle coupling lever.

* * * * *